US010034524B2

(12) United States Patent
Ma

(10) Patent No.: US 10,034,524 B2
(45) Date of Patent: Jul. 31, 2018

(54) UMBRELLA QUICK FRAME ASSEMBLY SYSTEMS AND METHODS

(71) Applicant: Zhun-An Ma, Arcadia, CA (US)

(72) Inventor: Zhun-An Ma, Arcadia, CA (US)

( * ) Notice: Subject to any disclaimer, the term of this patent is extended or adjusted under 35 U.S.C. 154(b) by 0 days.

(21) Appl. No.: 15/341,971

(22) Filed: Nov. 2, 2016

(65) Prior Publication Data

US 2017/0112242 A1 Apr. 27, 2017

Related U.S. Application Data

(62) Division of application No. 13/797,477, filed on Mar. 12, 2013, now Pat. No. 9,498,030.

(30) Foreign Application Priority Data

Apr. 19, 2012 (CN) ..... 2012 1 0116279

(51) Int. Cl.
*A45B 25/06* (2006.01)
*A45B 25/02* (2006.01)

(52) U.S. Cl.
CPC ..... *A45B 25/06* (2013.01); *A45B 25/02* (2013.01)

(58) Field of Classification Search
CPC ..... A45B 25/06; A45B 25/08
USPC ..... 135/19.5, 28–30
See application file for complete search history.

(56) References Cited

U.S. PATENT DOCUMENTS 331,231 A 11/1885 Folger
501,089 A 7/1893 Lichtenstein
620,815 A 3/1899 Warren
750,178 A 1/1904 Fesenfeld
770,704 A 9/1904 Vogel
847,805 A 3/1907 McAvoy
878,270 A 2/1908 Blake et al.
880,534 A 3/1908 Hoyt
(Continued)

FOREIGN PATENT DOCUMENTS

CA 1269018 5/1990
CN 204444542 7/2015
(Continued)

OTHER PUBLICATIONS

International Search Report and Written Opinion issued in PCT Application No. PCT/US2016/051771, dated Dec. 28, 2016.
(Continued)

*Primary Examiner* — Noah Chandler Hawk
(74) *Attorney, Agent, or Firm* — Knobbe Martens Olson & Bear LLP

(57) ABSTRACT

An umbrella hub is provided that includes an inner portion, an outer periphery, a lower portion and an upper portion. A plurality of vertical grooves is disposed in the outer periphery and is configured to receive umbrella ribs or struts. A plurality of grooves extends transverse to the plurality of vertical grooves. A retention member is disposed in each of the transverse grooves. A first configuration of the hub permits deflection of the retention member such that a transverse pin coupled with the umbrella ribs or struts can be inserted into the transverse groove in which the retention member is disposed. A second configuration of the hub prevents deflection of the retention member such that inadvertent withdrawal of the pin from the transverse groove in which the retention member is disposed is prevented.

13 Claims, 16 Drawing Sheets

(56) References Cited

U.S. PATENT DOCUMENTS 897,026 A 8/1908 Seitzinger
928,169 A 7/1909 Bardon
941,952 A 11/1909 Riehl
947,790 A 2/1910 Carter
959,127 A 5/1910 Edwards
1,001,076 A 8/1911 Redford
1,022,944 A 4/1912 Hodinger
1,078,069 A 11/1913 Simons
1,107,415 A 8/1914 Drohan
1,264,075 A 4/1918 Hout
1,469,495 A 10/1923 Bunker
1,808,610 A 6/1931 Roy
2,101,510 A 12/1937 Rathbun
2,207,043 A 7/1940 Weiss et al.
2,321,495 A 6/1943 Levin
2,336,116 A 12/1943 Morando
2,385,575 A 9/1945 Isler
2,469,637 A 5/1949 Wayne et al.
2,635,616 A 4/1953 Haydu
2,762,383 A 9/1956 Wittman
2,796,073 A 6/1957 Wittman
2,860,647 A 11/1958 Negri
2,914,154 A 11/1959 Russell
3,157,186 A * 11/1964 Hammer ..... A45B 25/06 135/28
3,177,882 A 4/1965 Vincent
3,252,468 A 5/1966 Militano
3,330,582 A 7/1967 Morris
3,424,180 A 1/1969 Andolfi
3,462,179 A 8/1969 Hinkle
3,557,809 A 1/1971 Vazquez et al.
3,643,673 A 2/1972 Weber
3,704,479 A 12/1972 Whitaker
D231,955 S 6/1974 Weber
4,201,237 A 5/1980 Watts et al.
4,368,749 A 1/1983 Lindler et al.
4,369,000 A 1/1983 Egnew
4,627,210 A 12/1986 Beaulieu
4,673,308 A 6/1987 Reilly
4,750,509 A 6/1988 Kim
4,790,338 A 12/1988 Strobl
4,941,499 A 7/1990 Pelsue et al.
4,966,178 A 10/1990 Eichhorn
D320,111 S 9/1991 Ma
5,056,291 A 10/1991 Leung
D321,779 S 11/1991 Ma
5,069,572 A 12/1991 Niksic
5,085,239 A 2/1992 Chin-Hung et al.
5,188,137 A 2/1993 Simonelli
5,193,566 A 3/1993 Chen
5,328,286 A 7/1994 Lee
D360,522 S 7/1995 Ko
5,433,233 A 7/1995 Shiran et al.
5,445,471 A 8/1995 Wexler et al.
5,738,129 A 4/1998 Vogt
5,740,824 A 4/1998 Tang
5,797,613 A 8/1998 Busby
5,797,695 A 8/1998 Prusmack
5,842,494 A 12/1998 Wu
D411,655 S 6/1999 Tung
5,911,233 A 6/1999 Wu
D412,056 S 7/1999 Wang
6,076,540 A 6/2000 You
6,095,169 A 8/2000 Lin et al.
6,199,572 B1 3/2001 Rousselle et al.
6,227,753 B1 5/2001 Boer
6,311,706 B1 11/2001 Sato
6,314,976 B1 11/2001 Clarke
6,332,657 B1 12/2001 Fischer
6,345,637 B1 2/2002 Ko
6,354,316 B1 3/2002 Chen
6,374,840 B1 4/2002 Ma
6,386,215 B1 5/2002 Chang
6,397,867 B2 6/2002 You
D460,947 S 7/2002 Montena
D465,915 S 11/2002 Earnshaw
6,604,844 B2 8/2003 Hussey
6,643,889 B1 11/2003 Kotlarski
6,701,946 B2 3/2004 You
6,705,335 B2 3/2004 You
6,758,228 B1 7/2004 You
6,758,354 B2 7/2004 Carletti
6,814,093 B2 11/2004 You
7,178,535 B2 2/2007 Eder
7,464,503 B2 12/2008 Hoberman
7,481,235 B2 1/2009 Prusmack
7,574,777 B1 8/2009 Fuller et al.
7,637,276 B2 12/2009 Mallookis et al.
7,703,464 B2 4/2010 Ma
D623,396 S 9/2010 He
D626,324 S 11/2010 Ma
7,861,734 B2 1/2011 Ma
D631,848 S 2/2011 Montena et al.
7,891,367 B2 2/2011 Ma
8,061,375 B2 11/2011 Ma
8,069,872 B2 12/2011 Bae
8,082,935 B2 12/2011 Ma
8,082,937 B2 12/2011 Tarter et al.
8,166,986 B2 5/2012 Ma
D661,659 S 6/2012 Natoli et al.
D662,064 S 6/2012 Natoli et al.
D668,446 S 10/2012 Patzak
D670,901 S 11/2012 Rothbucher et al.
8,356,613 B2 1/2013 Ma
8,360,085 B2 1/2013 Lee
8,485,208 B2 7/2013 Seo
8,496,019 B2 7/2013 Zhou
8,555,905 B2 10/2013 Ma
D719,342 S 12/2014 Ma
D719,343 S 12/2014 Ma
9,078,497 B2 7/2015 Ma
D738,609 S 9/2015 Ma
9,192,215 B2 11/2015 Ma
D744,742 S 12/2015 You
D749,835 S 2/2016 Whitaker
D750,364 S 3/2016 Lah
9,433,269 B2 9/2016 Ma
9,498,030 B2 11/2016 Ma
D786,661 S 5/2017 Wright
2001/0007260 A1 7/2001 Rousselle et al.
2004/0025915 A1 2/2004 Wang
2004/0123891 A1 7/2004 Ma
2005/0115599 A1 6/2005 You
2006/0005867 A1 1/2006 Chang
2006/0124160 A1 6/2006 Lee
2007/0172310 A1 7/2007 Yang et al.
2009/0071518 A1 3/2009 Amsel
2009/0126769 A1 5/2009 Hoogendoorn
2009/0260664 A1 10/2009 Ma
2010/0288318 A1 11/2010 Beaulieu
2011/0017249 A1 1/2011 Ma
2011/0132418 A1 6/2011 Ma
2011/0214705 A1 9/2011 Ma
2012/0318316 A1 12/2012 Choi et al.
2013/0008478 A1 1/2013 Prieto
2014/0026931 A1 1/2014 Lee
2014/0246062 A1 9/2014 Ma
2014/0251394 A1 9/2014 Ma
2015/0237977 A1 8/2015 Ma
2016/0115707 A1 4/2016 Schneider et al.
2017/0073993 A1 3/2017 Ma

FOREIGN PATENT DOCUMENTS

DE 1152226 8/1963
EP 0202769 12/1989
EP 0897678 A1 * 2/1999 ..... A45B 25/06
FR 855628 5/1940
FR 002650491 2/1991
FR 2857835 1/2005
GB 2113543 8/1983
GB 2165448 11/1987
JP 61131921 8/1986
KR 100851744 8/2008

(56) References Cited

FOREIGN PATENT DOCUMENTS

| | | |
|---|---|---|
| KR | 10-2009-0110808 | 10/2009 |
| KR | 10-2012-0107607 | 10/2012 |
| WO | WO 2005/023042 | 3/2005 |
| WO | WO 2017/048868 | 3/2017 |

OTHER PUBLICATIONS

EPO Extended Search Report dated Apr. 5, 2011 for European Patent No. 09252140.0, filed Sep. 7, 2009.
Extended European Search Report issued in EP Application No. 14157685, dated Jul. 7, 2014, in 8 pages.
Extended European Search Report issued in EP Application No. 14158057, dated Jul. 7, 2014, in 7 pages.
Extended European Search Report issued in EP Application No. 15156587.6, dated Jul. 23, 2015, in 7 pages.
Treasure Garden, 2010 Products Catalog, pp. 20 and 60.

* cited by examiner

UMBRELLA QUICK FRAME ASSEMBLY SYSTEMS AND METHODS

CROSS-REFERENCE TO RELATED APPLICATIONS

This application claims the benefit of Chinese Patent Application No. 201210116279.0, filed Apr. 19, 2012, and U.S. patent application Ser. No. 13/797,477 filed Mar. 12, 2013, the entirety of which are hereby incorporated by reference for all purposes.

BACKGROUND OF THE INVENTION

Field of the Invention

This invention involves the technical aspects of an umbrella, especially the technical aspects of the upper and lower runners, sometimes referred to herein as hubs, of an umbrella. It specifically refers to the upper and lower runners of a quick frame assembly system and the relevant umbrella and the quick frame assembly method.

Description of the Related Art

An earlier frame assembly method for attaching the ribs to the upper and lower runners of an umbrella frame is: The upper and lower runners are provided with annular grooves and the ribs have through holes. Iron wires are inserted into the through holes of multiple ribs and are tightly wound in the annular grooves. Tools are required to carry out the assembly and the protruding ends of the wire could injure a user or assembler. The umbrella is difficult to assemble and requires extra care.

The current frame assembly method is: the two sides of one end of the umbrella ribs have lugs and the upper and lower runners are both divided into the hollow runner body and base. There are several U-shaped slots around the outer periphery of the hollow runner body. The two lugs on the rib are respectively situated in the two U-shaped slots. The base is fitted into the hollow runner body to seal up the U-shaped slots. The hollow runner body is provided with fasteners, i.e. for areas that can be fastened, and the fasteners pierce into the base and become secured.

SUMMARY OF THE INVENTIONS

These inventions herein hope to provide another type of quick frame assembly system with upper and lower runners, and where no fixtures, tools or screws are required for the frame assembly. The assembly is quick, easy and flexible, and the ribs can either be assembled vertically or horizontally.

Some of the objectives of these inventions are to address the shortcomings of the prior technology mentioned above by providing the upper and lower runners of a quick frame assembly system and the relevant umbrella frame and the quick frame assembly method. The upper and lower runners are cleverly designed and structurally simple. No fixtures, tools or screws are required for the frame assembly. The assembly is quick, easy and flexible, and the ribs can either be assembled vertically or horizontally. It is also suitable for large-scale application.

In order to achieve the aforementioned objective, the first aspect of this invention provides an upper runner of a quick frame assembly system comprising an upper runner cover and an upper runner base, wherein several upper runner rib hitching grooves or coupling grooves are disposed around the circumference of the outer periphery of the upper runner cover. A first upper runner vertical groove is located between the upper runner rib hitching grooves. The upper runner base has several upper runner stop blocks or retention members. A second upper runner vertical groove is located on the outer periphery of the upper runner base. The first vertical groove is aligned with the second vertical groove. The upper runner cover and the upper runner base should be able to fit into each other and become mutually fastened at positions 1 and 2. At position 1, the upper runner stop block is set into the respective upper runner rib hitching groove and seals up blocks, or encloses a portion of the upper runner rib hitching groove. At position 2, the upper runner stop block is set into the respective upper runner rib hitching groove and seals up, blocks, or encloses all of the upper runner rib hitching groove.

Preferably, the upper runner cover has a first upper runner inverted fastening unit and a second upper runner inverted groove. The upper runner base should have a first upper runner inverted groove and a second upper runner inverted fastening unit. At position 1, the first upper runner inverted fastening unit is fastened to the first upper runner inverted groove. At position 2, the second upper runner inverted fastening unit is fastened to the second upper runner inverted groove.

More preferably, there should be at least two (2) of the first upper runner inverted fastening units. The first upper runner inverted fastening units should be symmetrical with respect to the axis of the corresponding upper runner cover. There should be at least two (2) of the first upper runner inverted grooves. The first upper runner inverted fastening grooves should be symmetrical with respect to the axis of the corresponding upper runner base.

More preferably, there should be at least two (2) of the second upper runner inverted grooves. The second upper runner inverted grooves should be symmetrical with respect to the axis of the corresponding upper runner cover. There should be at least two (2) of the second upper runner inverted fastening units. The second upper runner inverted astening units should be symmetrical with respect to the axis of the corresponding upper runner base.

Preferably, the center of the said upper runner cover has a hollow sleeve and the upper runner base is fitted into or over the said hollow sleeve.

More preferably, the lower section of the hollow sleeve is provided with positioning holes.

The second aspect of this invention provided a lower runner of a quick frame assembly system comprising a lower runner cover and a lower runner base, wherein several lower runner rib hitching grooves or coupling grooves are disposed around the circumference of the outer periphery of the said lower runner cover. A first lower runner vertical groove is located between the lower runner rib hitching grooves. The said lower runner base has several lower runner stop blocks or retention member. A second lower runner vertical groove is located on the outer periphery of the said lower runner base. The first vertical groove is aligned with the second vertical groove. The lower runner cover and the lower runner base should be able to fit into each other and be mutually fastened at first and second positions. At the first position, the lower runner stop block is set into the respective lower runner rib hitching groove and seals up, blocks, or encloses a portion of the lower runner rib hitching groove. In this context and as similarly discussed herein "seals up" and "encloses" can include a condition where the stop block partially blocks access to or egress from the hitching groove. As discussed further below in this position, the stop block is permitted to flex sufficiently to permit pins attached to ribs to be inserted into the hitching grooves. At the second position, the lower runner stop block is set into the respective lower runner rib hitching groove and seals up all of or completely encloses all of the lower runner rib hitching groove. In this context and as similarly discussed herein "seals up all" and "completely encloses" can include a condition where the stop block fully blocks access to or egress from the hitching or coupling groove. As discussed further below in this position, the stop block is braced so that it does not permit ribs or pins coupled with ribs to be inadvertently withdrawn from the hitching grooves.

Preferably, the lower runner cover has a first lower runner inverted fastening unit and a second lower runner inverted groove. The lower runner base should have a first lower runner inverted groove and a second lower runner inverted fastening unit. At the first fastening position, the first lower runner inverted fastening unit is fastened to the first lower runner inverted groove. At the second fastening position, the second lower runner inverted fastening unit is fastened to the second lower runner inverted groove.

More preferably, there should be at least two (2) of the first lower runner Inverted Fastening Units. The first lower runner Inverted Fastening Units should be symmetrical with respect to the axis of the corresponding lower runner cover. There should be at least two (2) of the first lower runner Inverted Grooves. The first lower runner inverted grooves should be symmetrical with respect to the axis of the said corresponding lower runner base.

More preferably, there should be at least two (2) of the second lower runner inverted fastening units. The second lower runner inverted fastening units should be symmetrical with respect to the axis of the corresponding lower runner cover. There should be at least two (2) of the second lower runner inverted grooves. The second lower runner inverted grooves should be symmetrical with respect to the axis of the said corresponding lower runner base.

Preferably, the lower runner cover has a first center hole. The lower runner cover also preferably has a third lower runner inverted fastening unit. The third lower runner inverted fastening unit can be located at an extension of the edge of the first center hole. The lower runner base should have a second center hole. The second center hole can have a third lower runner inverted groove. At the second fastening position, the third lower runner inverted fastening unit can be fastened to the third lower runner inverted groove.

More preferably, there should be at least two (2) of the third lower runner inverted fastening units. The third lower runner inverted fastening units can be symmetrical with respect to the axis of the corresponding lower runner cover. There should be at least two (2) of the third lower runner inverted grooves. The third lower runner inverted grooves can be symmetrical with respect to the axis of the corresponding lower runner base.

The third aspect of this invention provides an umbrella frame comprising first ribs and a shaft. One end of the first ribs has first shaft pins. The umbrella further comprises any of the upper runner embodiments discussed in this application. The upper runner is installed on the shaft. The upper runner cover and the upper runner base mutually come together at the second position. One end of the first ribs is situated in the first upper runner vertical groove. The two ends of the shaft pins are situated in the two adjacent upper runner rib hitching grooves. The shaft pins are immobilized by the upper runner stop blocks situated in the upper runner rib hitching grooves. In this context, "immobilized" means retained or prevented from being withdrawn inadvertently, but permitting at least rotational movement so that the ribs can swing through typical range of motion for opening and closing the umbrella.

Preferably, the center of the upper runner cover has a hollow sleeve. The upper runner base is inserted into or is advanced over the hollow sleeve and the hollow sleeve is set into the shaft. The upper runner base is held up against the shaft.

More preferably, the lower section of the hollow sleeve is provided with one or more positioning holes and the shaft is provided with fastener holes. The positioning holes and the fastener holes are connected with fasteners.

The fourth aspect of this invention provided an umbrella frame comprising of second ribs and a shaft. One end of the second ribs has second shaft pins. The umbrella further comprises any of the embodiments of the lower runner of a quick frame assembly system as discussed herein. The lower runner is mounted and slides on the shaft. The lower runner cover and the lower runner base mutually come together at the second position. One end of the second ribs is situated in the first lower runner vertical groove, and the two ends of the second shaft pins are situated in the two adjacent lower runner rib hitching grooves and are immobilized with the lower runner stop blocks situated in the lower runner rib hitching grooves. As discussed above, "immobilized" here means retained or prevented from being withdrawn inadvertently, but permitting at least rotational movement so that the ribs can swing through typical range of motion for opening and closing the umbrella.

Preferably, the lower runner cover has a first center hole, and The lower runner cover preferably also has a third lower runner inverted fastening unit that can be located at an extension of the edge of the first center hole. The lower runner base should have a second center hole. The second center hole preferably has a third lower runner inverted groove. The third lower runner inverted fastening unit can be fastened to the third lower runner inverted groove. The shaft goes through the first center hole 1 and the second center hole and is secured with the third lower runner inverted fastening unit.

The fifth aspect of this invention provides an umbrella frame comprising first ribs, second ribs, and a shaft. One end of the first ribs has first shaft pins. One end of the second ribs has second shaft pins. The other end of the second ribs is swivel-connected to a central portion of the first ribs. The umbrella further comprises any of the upper runners and any of the lower runners of a quick frame assembly system described herein. The upper runner is installed on the shaft. The upper runner cover and the upper runner base mutually come together at the second position. One end of the first ribs is situated in the upper runner vertical groove and the two ends of the first shaft pins are situated in the two adjacent upper runner rib hitching grooves. The two ends of the first shaft pins are immobilized by the said upper runner stop blocks situated in the upper runner rib hitching grooves. "Immobilized" has the broad meaning discussed above in this regard. The lower runner is mounted and slides on the shaft and is situated below the upper runner. The lower runner cover and the lower runner base mutually come together at the second position. One end of the second ribs is situated in the lower runner vertical groove, and the two ends of the second shaft pins are situated in the two adjacent lower runner rib hitching grooves. The second shaft pins are immobilized by the lower runner stop blocks situated in the lower runner rib hitching grooves. "Immobilized" has the broad meaning discussed above in this regard.

The sixth aspect of this invention provides a quick frame assembly method realized using the abovementioned upper runner of a quick frame assembly system, wherein includes any combination or all of the following steps:

(1) The upper runner cover and the upper runner base are fitted together to cause the upper runner cover and the upper runner base to become mutually attached at the first position, thereby the upper runner stop block is respectively inserted into the upper runner rib hitching groove in a manner that seals up a portion of (e.g., partially blocks or encloses) the upper runner rib hitching groove;

(2) One end of the first rib is inserted into the upper runner vertical groove and the two ends of the first shaft pins installed at one end of the first ribs are respectively positioned in the two adjacent upper runner rib hitching grooves, with further advancement of the first ribs causing the first shaft pins to press against the upper runner stop block. At least a portion of the upper runner stop block will exit (e.g., be deflected away or at least partially out of) the upper runner rib hitching groove as a result of the elastic deformation of the upper runner stop block or the elastic deformation of the upper runner cover and/or the upper runner base, and thus the first shaft pins are able to enter the upper runner rib hitching grooves. Thereafter, the upper runner stop block returns to its original position to immobilize the first shaft pins;

(3) The upper runner cover and the upper runner base move closer to each other to allow the upper runner cover and the upper runner base to become mutually attached at the second position, thereby the upper runner stop block moves further into the upper runner rib hitching groove and in turn seals up the entire upper runner rib hitching groove to firmly immobilize the shaft pins. "Seals up" and "immobilize" have the broad meaning discussed elsewhere herein.

Preferably, the upper runner cover should have a first upper runner inverted fastening unit and the upper runner base should have a first upper runner inverted groove. In the step (1), the upper runner cover and the upper runner base should be able to become mutually attached at the first position through the attaching of the first upper runner inverted fastening unit to the first upper runner inverted groove.

Preferably, the upper runner cover should have a second upper runner inverted groove and the upper runner base should have a second upper runner inverted fastening unit. In the step (3), the upper runner cover and the upper runner base should be able to become mutually attached at the second position through the attaching of the second upper runner inverted fastening unit to the second upper runner inverted groove.

The seventh aspect of this invention provides a quick frame assembly method realized using any of the abovementioned lower runners of a quick frame assembly system, wherein the method includes any combination or all of the following steps:

(A) The lower runner cover and the lower runner base are fitted together to cause the lower runner cover and the lower runner base to be able to mutually come together at the first fastening position, thereby the lower runner stop block is respectively inserted into the lower runner rib hitching groove and this seals up a portion of (as broadly defined herein) the lower runner rib hitching groove;

(B) One end of the second rib is inserted into the lower runner vertical groove and the two ends of the second shaft pins, installed at one end of the second ribs, are respectively positioned in the two adjacent lower runner rib hitching grooves, with further advancement of the second ribs causing the shaft pins to press against the lower runner stop block. At least a portion of the lower runner stop block will exit (e.g., be deflect away or at least partially out of) the lower runner rib hitching groove as a result of the elastic deformation of the lower runner stop block or the elastic deformation of the lower runner cover and/or the lower runner base. The second shaft pins are then able to enter the lower runner rib hitching grooves. Thereafter, the lower runner stop block returns to its original position to immobilize (as broadly defined herein) the second shaft pins;

(C) The lower runner cover and the lower runner base move closer to each other to allow the lower runner cover and the lower runner base to become mutually attached at the second position, thereby the lower runner stop block moves further into the lower runner rib hitching groove and this in turn seals up the entire (as broadly defined herein) lower runner rib hitching groove to firmly immobilize the second shaft pins.

Preferably, the lower runner cover should have a first lower runner inverted fastening unit and the lower runner base should have a first lower runner inverted groove. In step (A), the lower runner cover and the lower runner base should be able to become mutually attached at the first fastening position through the attaching of the first lower runner inverted fastening unit to the first lower runner inverted groove.

Preferably, the lower runner cover should have a second lower runner inverted groove and the lower runner base should have a second lower runner inverted fastening unit. In step (C), the lower runner cover and the lower runner base should be able to become mutually attached at the second fastening position through the attaching of the second lower runner inverted fastening unit to the second lower runner inverted groove.

Some of the specific benefits resulting from these inventions are:

1. The upper runner of various embodiments of this invention comprises an upper runner cover and an upper runner base. Several upper runner rib hitching grooves are created around the circumference of the outer periphery of the upper runner cover. A first upper runner vertical groove is located between the upper runner rib hitching grooves. The upper runner base has several upper runner stop blocks, and the second upper runner vertical groove is located on the outer periphery of the upper runner base. The first vertical groove is aligned with the second vertical groove, and the upper runner cover and the upper runner base should be able to fit into each other and become mutually attached at first and second positions. At the first position, the upper runner stop block is set into the respective upper runner rib hitching groove and seals up a portion (as broadly defined herein) of the upper runner rib hitching groove. At the second position, the upper runner stop block is set into the respective upper runner rib hitching groove and seals up the entire (as broadly defined herein) upper runner rib hitching grooves. After the upper runner cover and the upper runner base are thus fastened at the first position, elastic deformation is utilized to push the shaft pin on the rib to go beyond the upper runner stop block to enter into the upper runner rib hitching groove and it is then immobilized (as broadly defined herein) by the upper runner stop block. Thereafter, the upper runner cover and the upper runner base should come together at the second position, and the upper runner stop block moves further into the upper runner rib hitching groove to completely seal up (as broadly defined herein) the upper runner rib hitching groove, thereby completing the assembly of the rib with the upper runner in some embodiments. These inventions are cleverly designed and structurally simple. No fixtures, tools or screws are required for the rib assembly. The assembly is quick, easy and flexible, and the ribs can either be assembled vertically or horizontally. It is also suitable for large-scale application.

2. The lower runner of this invention comprises a lower runner cover and a lower runner base. Several lower runner rib hitching grooves are created around the circumference of the outer periphery of the lower runner cover. A first lower runner vertical groove is located between the lower runner rib hitching grooves. The lower runner base has several lower runner stop blocks. A second lower runner vertical groove is located on the outer periphery of the lower runner base. The first vertical groove is aligned with the second vertical groove, and the lower runner cover and the lower runner base should be able to fit into each other and become mutually fastened at the first and second positions. At the first position, the upper runner stop block is set into the respective upper runner rib hitching groove and seals up a portion of (as broadly defined herein) the lower runner rib hitching groove. At the second position, the lower runner stop block is set into the respective lower runner rib hitching groove and seals up the entire (as broadly defined herein) lower runner rib hitching groove. After the lower runner cover and the lower runner base are thus fastened at the first position, elastic deformation is utilized to push the shaft pin on the rib beyond the lower runner stop block to enter into the lower runner rib hitching groove. The shaft pin is then immobilized (as broadly defined herein) by the lower runner stop block. Thereafter, the lower runner cover and the lower runner base should come together at the second position, and the lower runner stop block moves further into the lower runner rib hitching groove to completely seal up (as broadly defined herein) the lower runner rib hitching groove, thereby completing the assembly of the rib in some embodiments. This invention is cleverly designed and structurally simple. No fixtures, tools or screws are required for the rib assembly. The assembly is quick, easy and flexible, and the ribs can either be assembled vertically or horizontally. It is also suitable for large-scale application.

An upper runner of a quick frame assembly system is provided that include an upper runner cover and an upper runner base. The system also includes a plurality of upper runner rib hitching grooves disposed around the circumference of the outer periphery of the upper runner cover. The system also includes a first upper runner vertical groove disposed between the upper runner rib hitching grooves. The upper runner base has several upper runner stop blocks and a second upper runner vertical groove disposed on the outer periphery of the upper runner base. The first upper runner vertical groove is aligned with the second vertical groove. The upper runner cover and the upper runner base are configured to fit together and become mutually fastened at first and second positions. At the first position, the upper runner stop blocks are disposed in the respective upper runner rib hitching grooves and partially blocks the upper runner rib hitching grooves. At the second position, the upper runner stop blocks are disposed in the respective upper runner rib hitching grooves and completely block the upper runner rib hitching grooves.

In another embodiment, an umbrella hub is provided that comprises an inner portion, an outer periphery, a lower portion and an upper portion. The lower portion comprises a lower surface of the hub. The upper portion comprises an upper surface of the hub. A plurality of grooves is disposed in the outer periphery configured to receive umbrella ribs or struts. A plurality of transverse slots is provided, where each slot extends transverse to the grooves. A retention member is disposed in each of the transverse slots. The hub comprises a first configuration that permits deflection of the retention member such that a transverse pin coupled with the umbrella ribs or struts can be inserted into the transverse slot in which the retention member is disposed. The hub comprises a second configuration that prevents deflection of the retention member such that inadvertent withdrawal of the pin from the transverse groove in which the retention member is disposed is prevented.

In another embodiment, an umbrella hub is provided that includes a hub body, a cavity disposed in the hub body, and a retention member disposed adjacent to the cavity. The hub has a first configuration that permits advancing an umbrella rib retention structure into the cavity and a second configuration. In the second configuration, the retention member prevents removing the umbrella rib retention from the cavity. The hub is actuated between the first and second configurations by moving the retention member. Such movement can be by moving one or both of upper and lower portions of the hub with which the retention member can be integrally formed.

In another embodiment, a quick frame assembly method is provided. In the method, a lower portion of a hub is coupled with an upper portion of the hub. The lower and/or upper portions define a first groove enabling movement of a rib or strut during umbrella operation. The upper and/or lower portions define a plurality of second grooves disposed transversely to the first groove. The retention structures are disposed on at least one of the upper and lower portions. The retention structures extend into the second grooves. One end of a first plurality of ribs is inserted into the first groove and ends of shaft pins of the ribs into the second grooves. The shaft pins are caused to press against the retention structures such that the retention structures are deflected. Deflection of the retention structures permits the shaft pins to be disposed in the second grooves, e.g., between the retention structures and a central axis of the hub. Relative movement is provided between the upper portion and the lower portion. Such movement moves the upper and lower portions of the hub to a position in which deflection of the retention members is prevented.

In another embodiment, an assembly method is provided. In the method, a lower portion of a hub is coupled in a first position with an upper portion thereof. The hub has a cavity. One end a rib is inserted into the hub such that an end of a transverse member of the rib is in the cavity. Relative movement is provided between the upper portion and the lower portion of the hub to block the transverse member from being dislodged from the cavity.

In another embodiment, a lower runner of a quick frame assembly system is provided that includes a lower runner cover and a lower runner base. The system also includes a plurality of lower runner rib hitching grooves disposed around the outer periphery of the lower runner cover. A first lower runner vertical groove is disposed between the lower runner rib hitching grooves. The lower runner base having several lower runner stop blocks and a second lower runner vertical groove disposed on the outer periphery of the said lower runner base. The first lower runner vertical groove is aligned with the second lower runner vertical groove. The lower runner cover and the lower runner base are configured to fit together and be mutually fastened at first and second positions. At the first Position, the lower runner stop blocks are disposed in respective lower runner rib hitching grooves and partially blocks the lower runner rib hitching grooves. At the second position, the lower runner stop blocks are set into the respective lower runner rib hitching grooves and completely block the lower runner rib hitching grooves.

In various combinations, umbrellas are provided that include any of the foregoing hubs or runners of a quick frame assembly systems.

In another embodiment, a quick frame assembly method is provided. In the method, a lower portion of a hub is coupled with an upper portion of a hub for rib assembly. The lower and/or upper portions define a first groove enabling movement of a rib or strut during umbrella operation. The upper and/or lower portions define a plurality of second grooves disposed transversely to the first groove. Retention structures that are disposed on at least one of the upper and lower portions extend into the second grooves. One end of a first plurality of ribs is inserted into the first groove and two pins or two ends of a shaft pin of the ribs are inserted into the second grooves. The shaft pin or ends of pins are pressed against the retention structures such that the retention structures are deflected, e.g. out of the second grooves, to permit further insertion of the pin (s). The deflection can be as a result of the elastic deformation of the retention structure and/or elastic deformation of at least one of the upper portion and the lower portion. The shaft pins or ends of are disposed in the second grooves between the retention structures and the central axis of the hub. The retention structures are permitted to return to an undeflected position to retain the shaft pins or ends. Relative movement is provided between the upper portion and the lower portion to move the upper and lower portions of the hub closer to each other to allow the said upper portion and the lower portion to become fully and mutually attached to prevent deflection of the retention members.

DETAILED DESCRIPTION OF THE PREFERRED EMBODIMENT

Figure 1A:
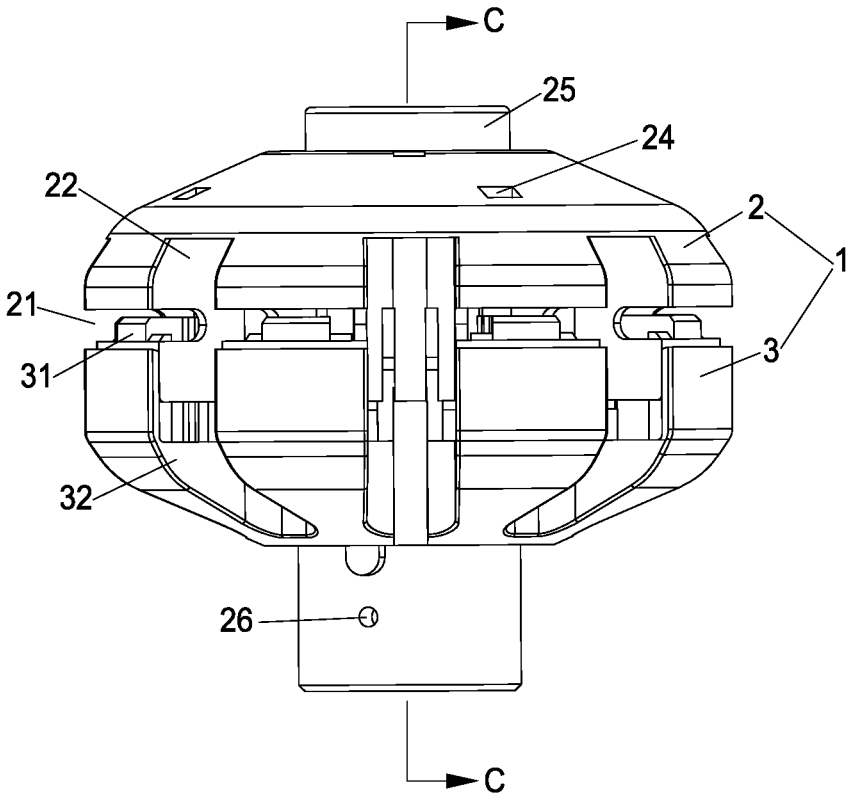
FIG. 1A is a schematic front view of a specific embodiment of the upper runner of this invention in a first fastening position.

In order to be able to understand the technical content of the embodiments more clearly, the following implementations are specially cited and described in detail.

With reference to FIGS. 1-7, an upper runner or hub 1 of this invention comprises an upper hub cover 2 and an upper hub base 3. Several upper hub rib hitching grooves or coupling grooves 21 are created around the circumference of the outer periphery of the upper hub cover 2. A first upper hub vertical groove 22 is located between the upper hub rib hitching grooves 21. The upper hub base 3 has several upper runner stop blocks 31. The stop blocks 31 are examples of retention members within the scope of the embodiments herein. A second upper hub vertical groove 32 is located on the outer periphery of the upper hub base 3. The first upper hub vertical groove 22 is aligned with the second upper hub vertical groove 32. The upper hub cover 2 and the upper hub base 3 should be able to fit into each other and become mutually fastened at positions 1 and 2. At the position 1, the upper hub stop blocks 31 are set into the respective upper hub rib hitching grooves 21 and these partially seal up all of the upper hub rib hitching grooves 21. At the position 2, the upper hub stop blocks 31 are set into the respective upper hub rib hitching grooves 21 and they completely seal up all the upper hub rib hitching grooves 21.

Any suitable structure can be employed to cause the upper hub cover 2 and the upper hub base 3 to become mutually fastened at positions 1 and 2. With reference to FIGS. 1-7, in the specific embodiment of this invention, the upper hub cover 2 has first upper hub inverted fastening units 23 and second upper hub inverted grooves 24. The upper hub base 3 has first upper hub inverted grooves 33 and second upper hub inverted fastening units 34. At the position 1, the first upper hub inverted fastening units 23 are fastened to the first upper hub inverted grooves 33. At the second position, the second upper hub inverted fastening units 34 are fastened to the second upper hub inverted grooves 24.

Figure 2A:
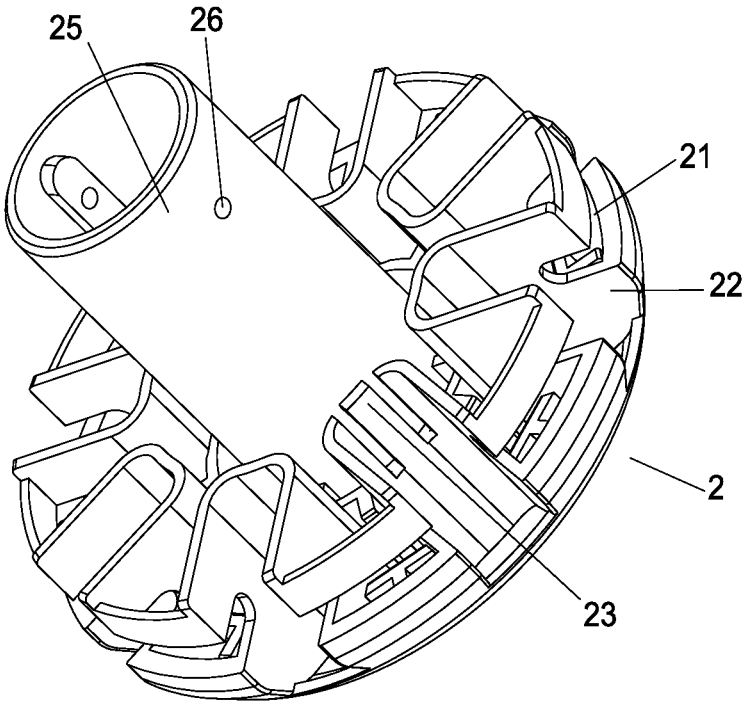
FIG. 2A is a schematic perspective view of a specific embodiment of the upper runner cover shown in FIG. 1.
Figure 2B:
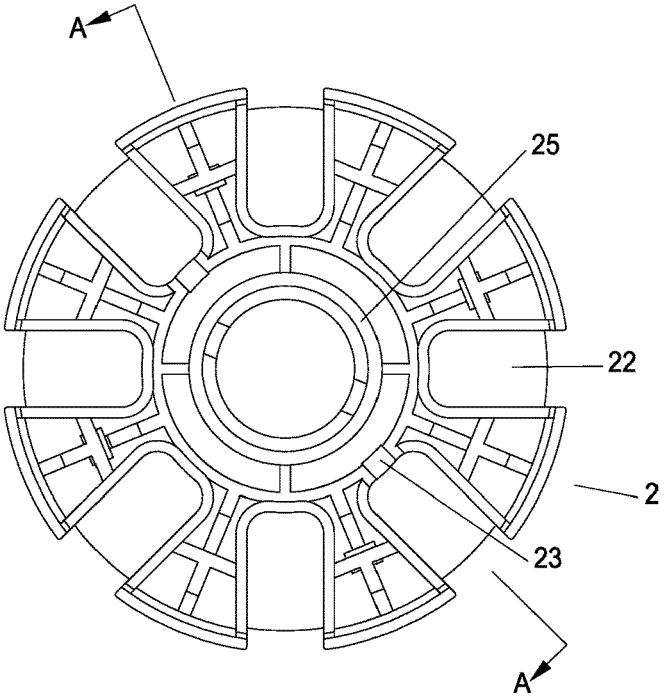
FIG. 2B is a schematic bottom view of a specific embodiment of the upper runner cover shown in FIG. 1.
Figure 3A:
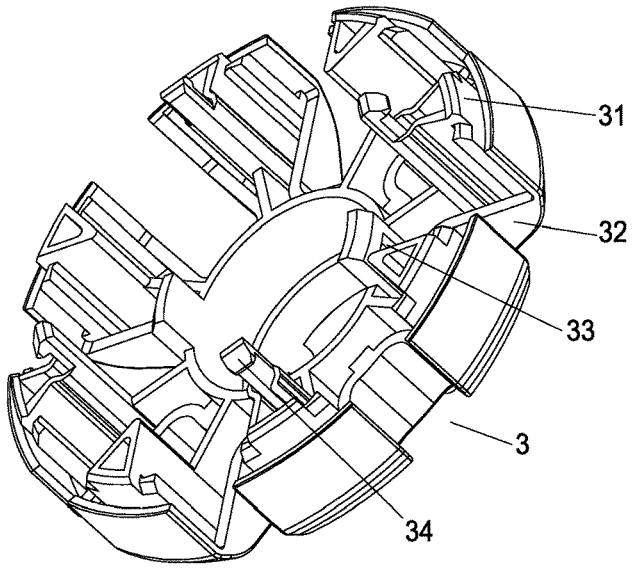
FIG. 3A is a schematic perspective view of a specific embodiment of the upper runner base shown in FIG. 1.

The quantity of the first upper hub inverted fastening units 23 and the upper hub inverted grooves 33 and their installation method can be arbitrarily defined. Preferably, there are at least two of the first upper hub inverted fastening units 23 that are symmetrical with respect to the axis of the corresponding upper hub cover 2. Preferably, there are at least two of the first upper hub inverted grooves 33 that are symmetrical with respect to the axis of the corresponding upper hub base 3. With reference to FIGS. 2B and 3A, in the specific embodiment of this invention, the quantity of the first upper hub inverted fastening units 23 and the first upper hub inverted grooves 33 is two.

Figure 3B:
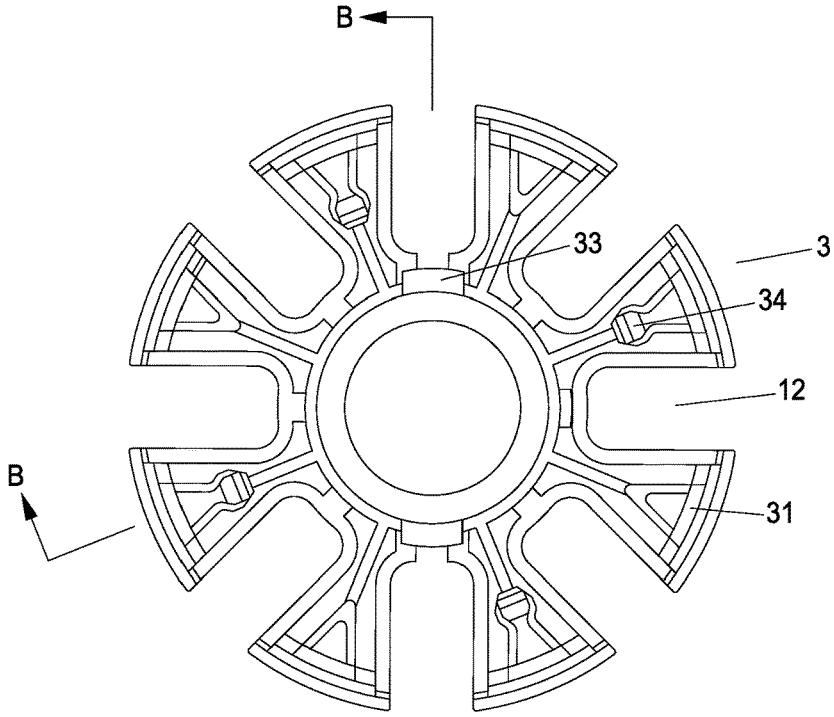
FIG. 3B is a schematic top view of a specific embodiment of the upper runner cover shown in FIG. 1.
Figure 3C:
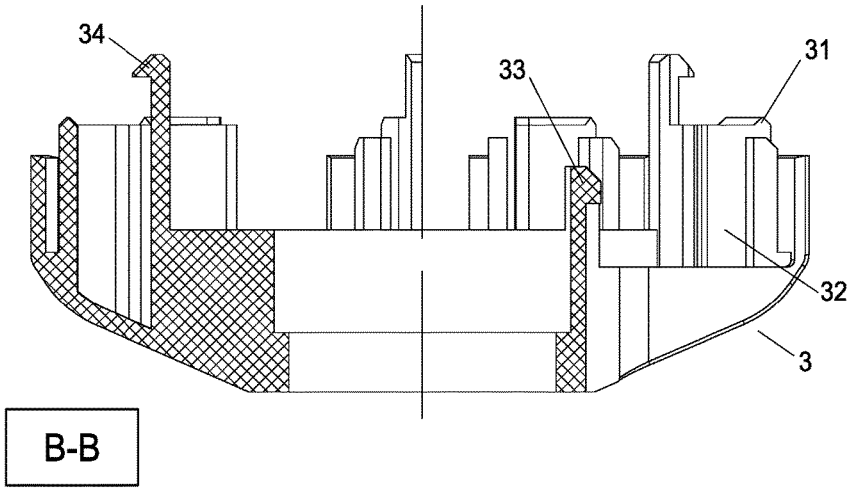
FIG. 3C is a schematic sectional view taken through section plane B-B in FIG. 3B.
Figure 5:
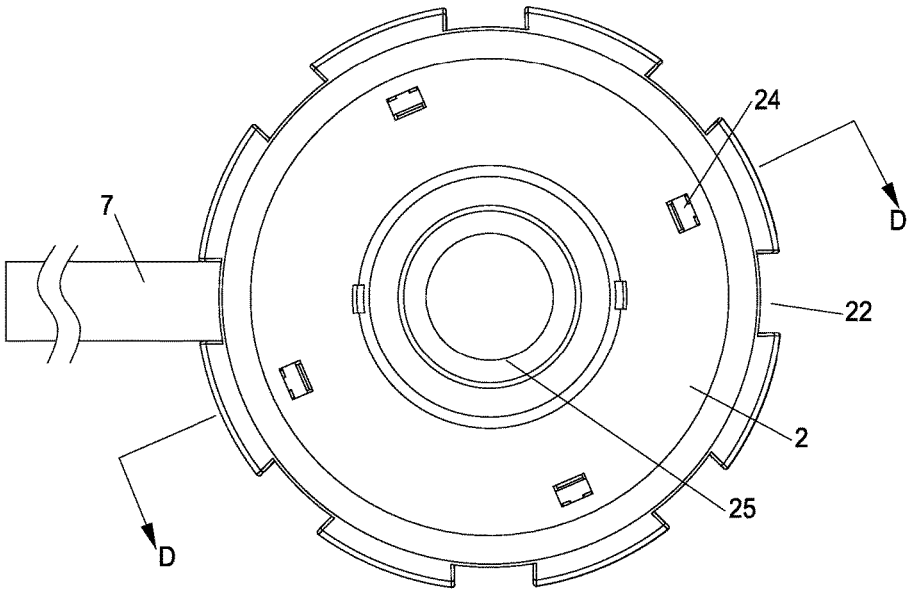
FIG. 5 is a schematic top view of a specific embodiment shown in FIG. 1.

The quantity of the second upper hub inverted fastening units 34 and the second upper hub inverted grooves 24 and their installation method can be arbitrarily defined. More preferably, there should be at least two of the second upper hub inverted grooves 24 and that are symmetrical with respect to the axis of the said corresponding upper hub cover 2. There also should be at least two of the second upper hub inverted fastening units. The second upper hub inverted fastening units preferably are symmetrical with respect to the axis of the said corresponding upper hub base 3. With reference to FIGS. 3A, 3B and 5, in the specific embodiment of this invention, the quantity of the second upper hub inverted fastening units 34 and the second upper hub inverted grooves 24 is four.

Figure 1B:
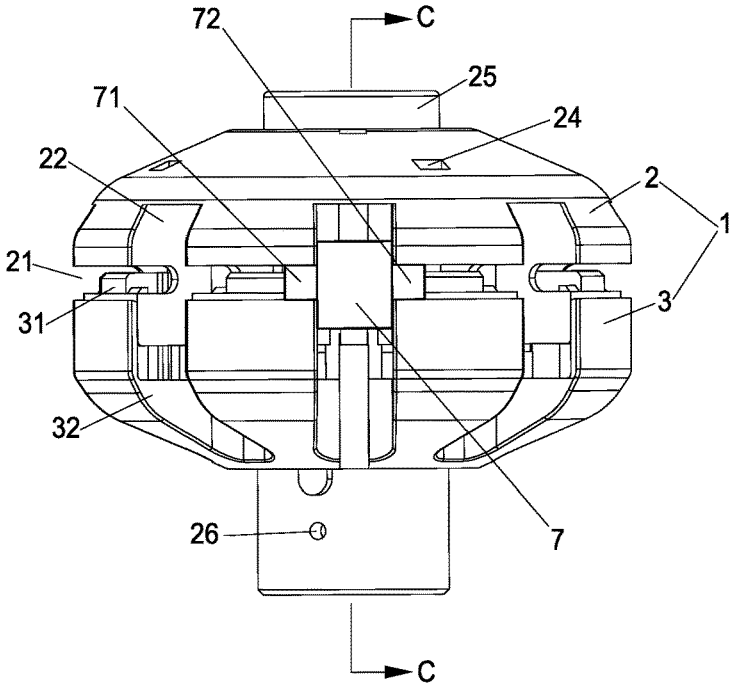
FIG. 1B shows the upper runner of FIG. 1A assembled with a rib having shaft pins.
Figure 1C:
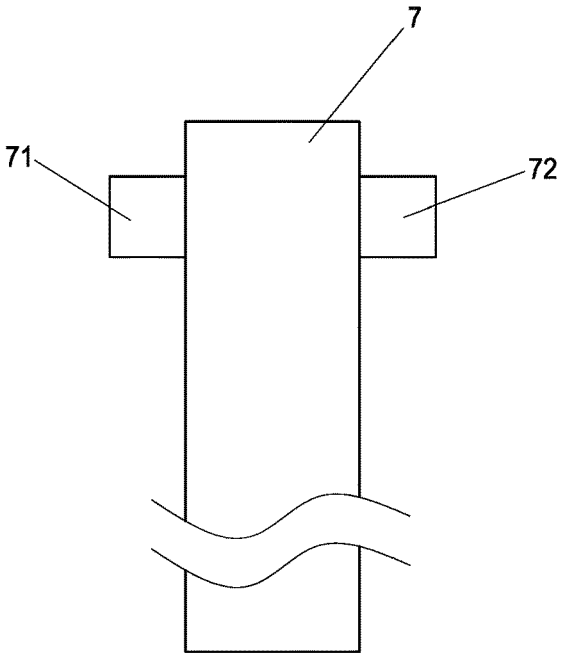
FIG. 1C illustrates the rib of FIG. 1B.
Figure 2C:
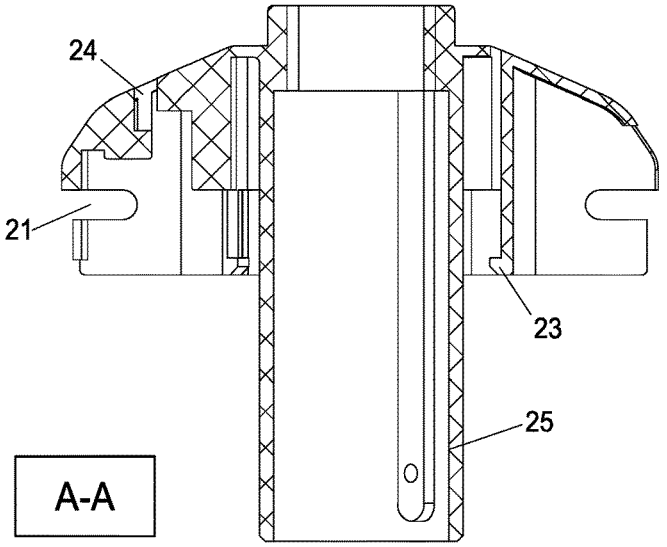
FIG. 2C is a schematic sectional view taken through section plane A-A in FIG. 2B.

Any suitable structure can be employed to install the upper hub 1 on the shaft 10. With reference to FIGS. 1-2C, in the specific embodiment of this invention, the center of the said upper hub cover 2 has a hollow sleeve 25 and the upper hub base 3 is fitted over the hollow sleeve 25. The upper hub 1 is installed on the shaft 10 by means of the hollow sleeve 25.

Any suitable structure can be employed to install the upper hub 1 on the shaft 10 by means of the hollow sleeve 25. With reference to FIGS. 1 and 2A, in various embodiments of this invention, the lower section of the hollow sleeve 25 is provided with positioning holes 26. The upper hub 1 is installed on the shaft 10 by means of the positioning holes 26.

With reference to FIGS. 8-12, the lower runner 4 comprises a lower runner cover 5 and a lower runner base 6. Several lower runner rib hitching grooves or coupling grooves 51 are created around the circumference of the outer periphery of the lower runner cover 5. A first lower runner vertical groove 52 is located between the lower runner rib hitching grooves 51. The lower runner base 6 has several lower runner stop blocks, or retention members 61. A second lower runner vertical groove 62 is located on the outer periphery of the lower runner base 6. The first vertical groove 52 is aligned with the second vertical groove 62, and the lower runner cover 5 and the lower runner base 6 should be able to fit into each other and be mutually attached at positions 1 and 2. At position 1, the lower runner stop blocks 61 are set into the respective lower runner rib hitching grooves 51 and partially seal up (as broadly defined herein) all the lower runner rib hitching grooves 51. At position 2, the lower runner stop blocks 61 are set into the respective lower runner rib hitching grooves 51 and completely seal up (as broadly defined herein) all the lower runner rib hitching grooves 51.

Any suitable structure can be employed to cause the lower runner cover 5 and the lower runner base 6 to become mutually fastened at positions 1 and 2. With reference to FIGS. 8-12, in specific embodiments, the lower runner cover 5 has first lower runner inverted fastening units 53 and second lower runner inverted grooves 54), and the lower runner base 6 has first lower runner inverted grooves 63 and second lower runner inverted fastening units 64. At position 1, the first lower runner inverted fastening units 53 are fastened to the first lower runner inverted grooves 63. At position 2, the second lower runner inverted fastening units 64 are fastened to the second lower runner inverted grooves 54.

Figure 9A:
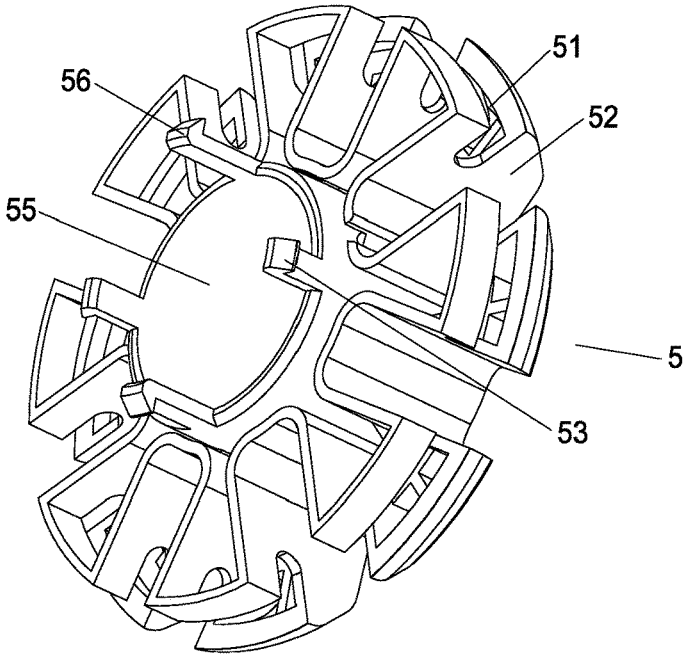
FIG. 9A is a schematic perspective view of a specific embodiment of the lower runner cover shown in FIG. 8.
Figure 9B:
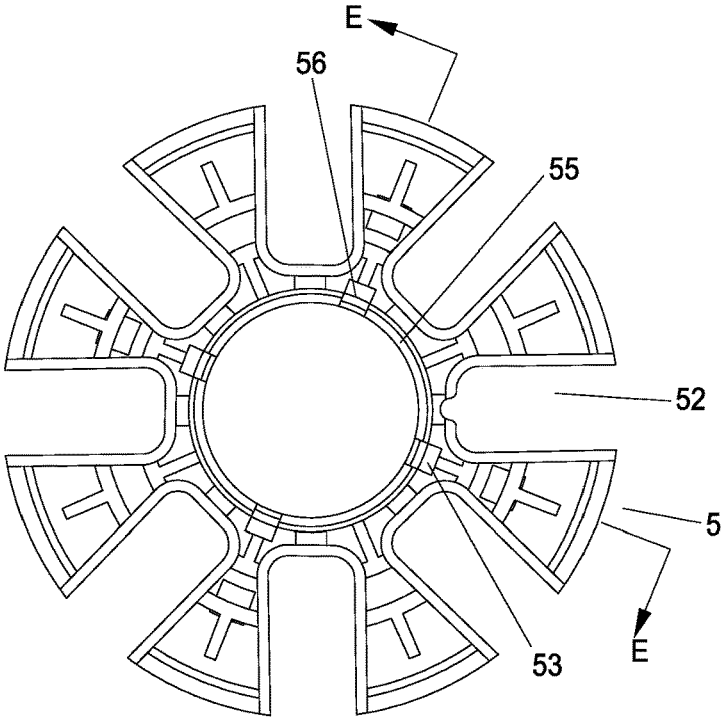
FIG. 9B is a schematic top view of a specific embodiment of the lower runner cover shown in FIG. 8.
Figure 9C:
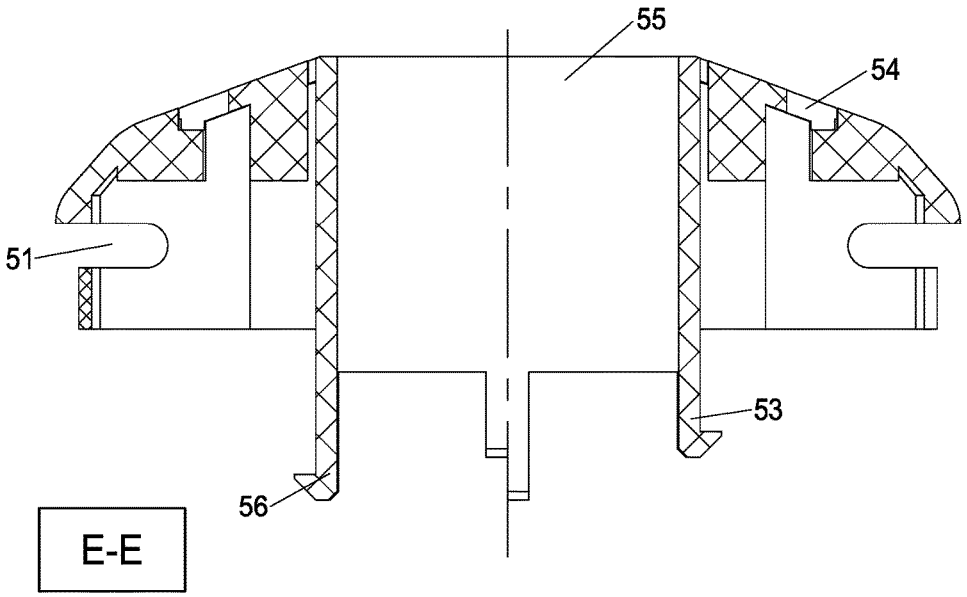
FIG. 9C is a schematic sectional view of taken through section plane E-E in FIG. 9B.
Figure 11:
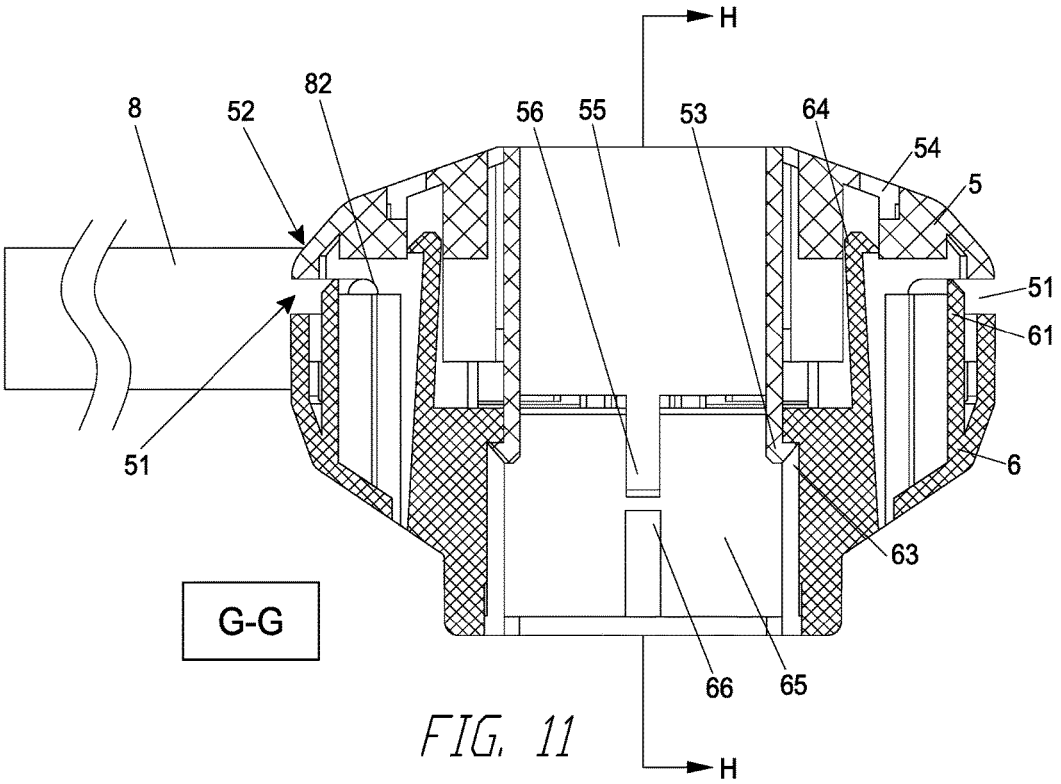
FIG. 11 is a schematic sectional view taken through section plane G-G in the lower runner shown in FIG. 8 with a rib having shaft pins.

The quantity of first lower runner inverted fastening units 53 and first lower runner inverted grooves 63 and their installation method can be arbitrarily defined. Preferably, there should be a plurality, e.g., at least two, of the first lower runner inverted fastening units 53. The first lower runner inverted fastening units 53 may be symmetrical with respect to the axis of the corresponding lower runner cover 5 There should be a plurality, e.g., at least two, of the first lower runner inverted grooves 63. The first lower runner inverted grooves 63 can be symmetrical with respect to the axis of the corresponding lower runner base 6. With reference to FIGS. 9A, 9B and 11, in a specific embodiment of this invention, there is a plurality, e.g., two of the first lower runner inverted fastening units 53 and the first lower runner Inverted Grooves 63.

Figure 10A:
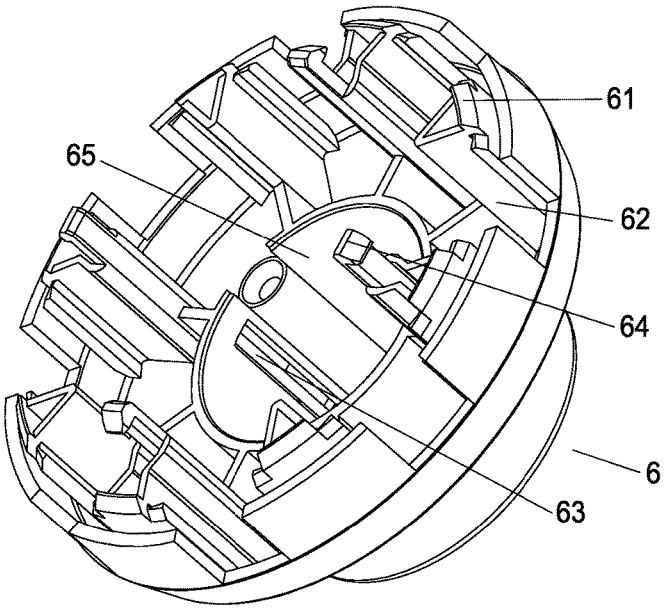
FIG. 10A is a schematic perspective view of a specific embodiment of the lower runner base shown in FIG. 8.
Figure 10B:
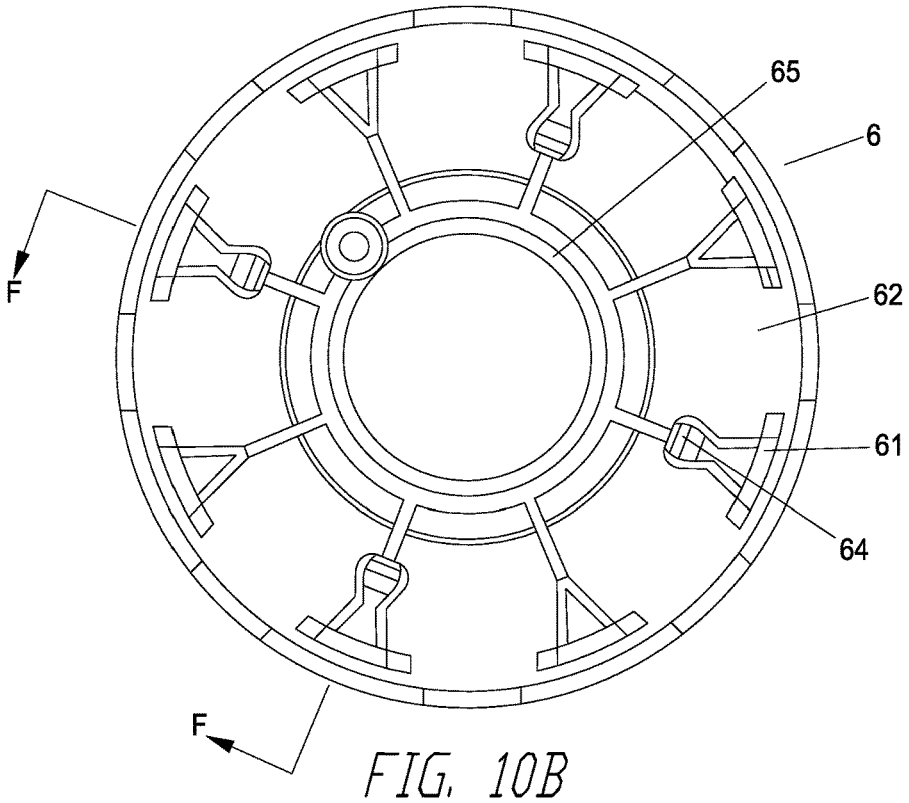
FIG. 10B is a schematic top view of a specific embodiment of the lower runner cover shown in FIG. 8.
Figure 10C:
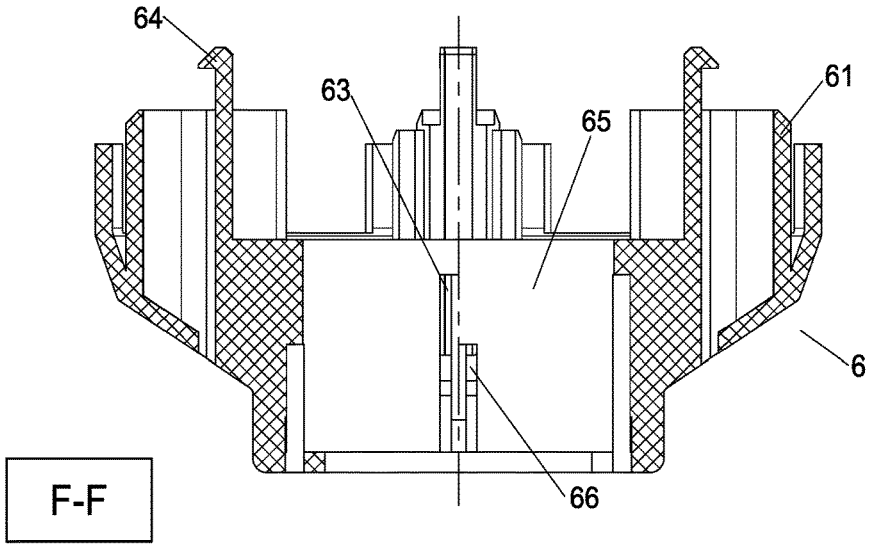
FIG. 10C is a schematic sectional view taken through section plane F-F in FIG. 10B.

The quantity of the second lower runner inverted fastening units 64) and the second lower runner inverted grooves 54 and their installation method can be arbitrarily defined. Preferably, there is a plurality, e.g., at least two of the second lower runner inverted grooves 54. The second lower runner inverted grooves 54 may be symmetrical with respect to the axis of the corresponding lower runner cover 5. There should be a plurality, e.g., at least two of the second lower runner inverted fastening units 64. The second lower runner inverted fastening units 64 may be symmetrical with respect to the axis of the said corresponding lower runner base 6. With reference to FIGS. 10A and 10B, in specific embodiments there is a plurality of, e.g., four of the second lower runner inverted fastening units 64 and the second lower runner Inverted Grooves 54.

In order to secure the connection, with reference to FIGS. 8-12, in the specific embodiment of this invention, the lower runner cover 5 has a first center hole 55. Third lower runner inverted fastening units 56 are located at the extension of the edge of the first center hole 55. The first center hole 55 can be an aperture, e.g., a short cylindrical structure that facilitates sliding movement along an umbrella pole. The lower runner base 6 should have a second center hole 65. The second center hole 65 preferably has third lower runner inverted grooves 66. The second center hole 65 can be an aperture, e.g., a short cylindrical structure that facilitates sliding movement along an umbrella pole. At the fastening position 2, the third lower runner inverted fastening units 56 are fastened to the third lower runner inverted grooves 66.

Figure 12:
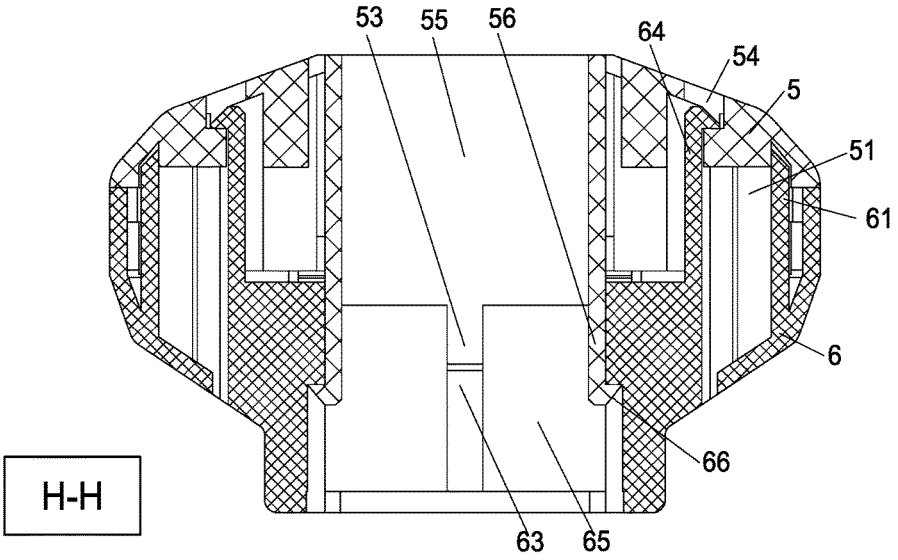
FIG. 12 is a schematic cross-sectional front view through section plane H-H in Figure 11 in a second fastening position.

The quantity of the third lower runner inverted fastening units 56 and the third lower runner inverted grooves 66 and their installation method can be arbitrarily defined. Preferably, there should be a plurality of, e.g., at least two of the third lower runner inverted fastening units 56. The third lower runner inverted fastening units 56 preferably are symmetrical with respect to the axis of the corresponding lower runner cover 5. There should be a plurality of, e.g., at least two of the third lower runner inverted grooves 66. The third lower runner inverted grooves preferably are symmetrical with respect to the axis of the said corresponding lower runner base 6. With reference to FIGS. 9A, 9B and 12, in specific embodiments, the quantity of the third lower runner inverted fastening units 56 and the third lower runner inverted grooves 66 is 2.

Figure 13:
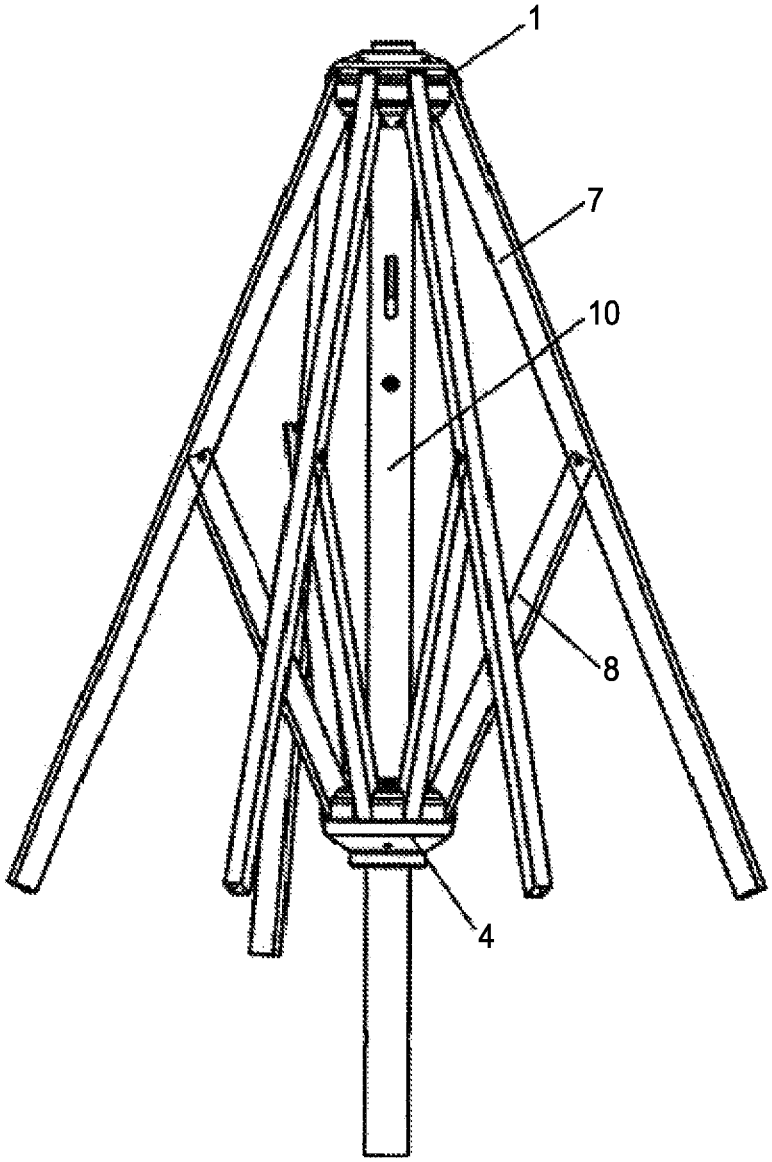
FIG. 13 is a schematic front view of a specific embodiment of the umbrella frame of this application with first and second ribs.
Figure 14:
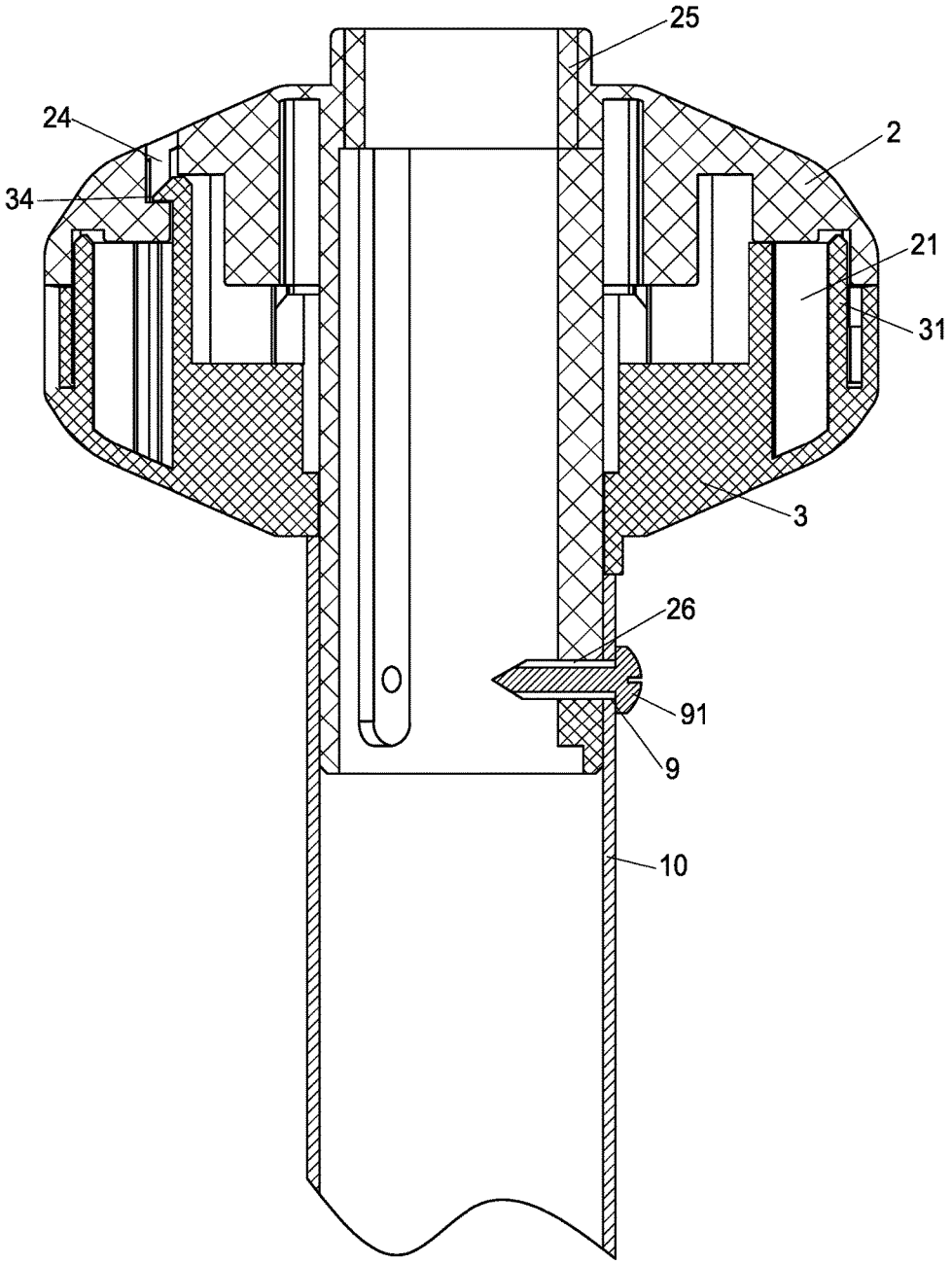
FIG. 14 is a schematic partial cross-sectional front view of an upper portion of the umbrella frame shown in FIG. 13.
Figure 15:
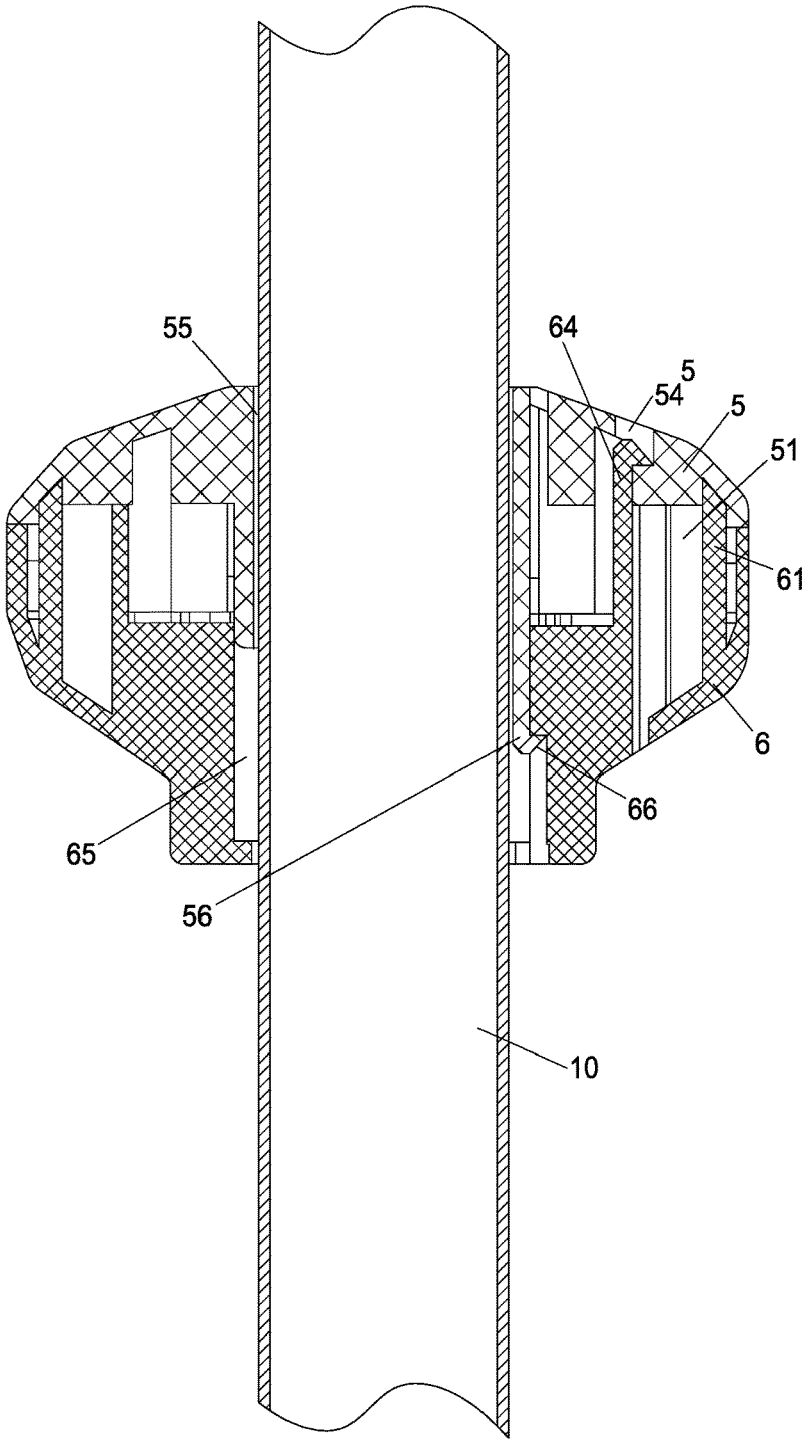
FIG. 15 is a schematic partial cross-sectional front view of a lower portion of the umbrella frame shown in FIG. 13.
Figure 16:
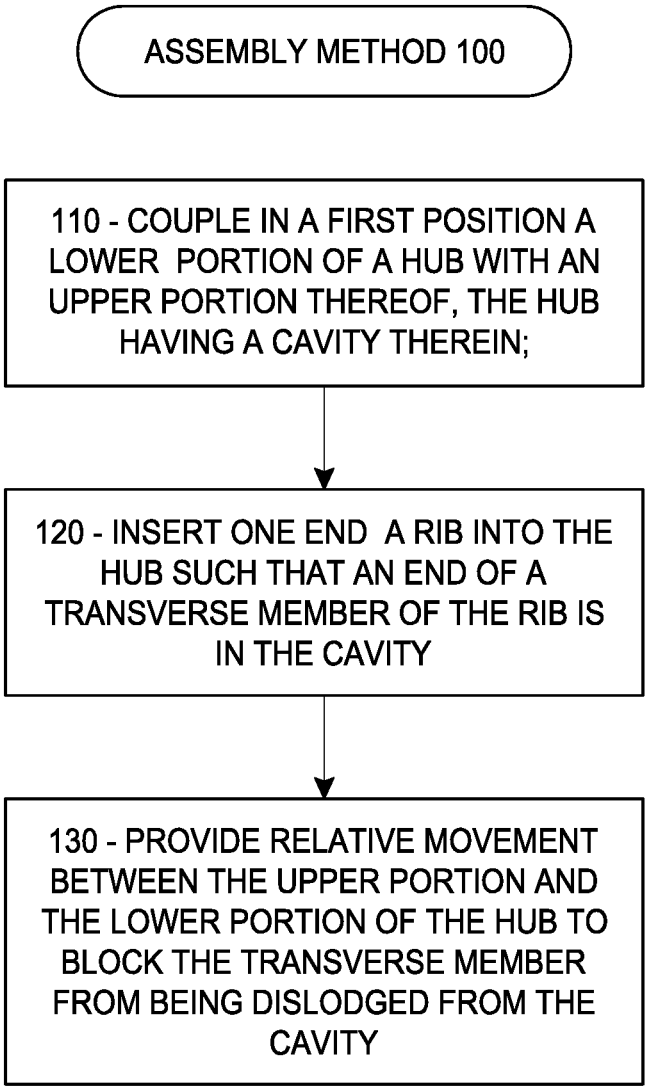
FIG. 16 is a flow chart showing a method of assembling an umbrella hub.

With respect to FIGS. 13-15, an umbrella frame of this invention comprises first ribs 7, second ribs 8 and a shaft 10. One end of the first ribs 7 has first shaft pins 71, 72. One end of the second ribs 8 has second shaft pins 81, 82 and the other end of the second ribs 8 is swivel-connected to the center of the first ribs 7. The umbrella frame further comprises the upper hub 2 and the lower runner 4 of a quick frame assembly system. The upper hub 1 is installed on the said shaft 10. The upper runner cover 2 and the said upper runner base 3 mutually come together at position 2. One end of the first ribs 7 is situated in the first upper runner vertical grooves 22, and the two ends of the first shaft pins 71, 72 are situated in two adjacent upper runner rib hitching grooves 21. The first shaft pins 71, 72 are retained by the upper runner stop blocks 31 situated in the upper runner rib hitching grooves 21. The lower runner 4 is mounted and slides on the said shaft 10 and is situated below the upper hub 1. The lower runner cover 5 and the lower runner base 6 mutually come together at the position 2. One end of the second ribs 8 is situated in the first lower runner vertical grooves 52, and the two ends of the second shaft pins 81, 82 are situated in the two adjacent lower runner rib hitching grooves 51 and are retained by the lower runner stop blocks 61 situated in the lower runner rib hitching grooves 51.

Any suitable structure can be employed to install the upper hub 1 on the shaft 10. With reference to FIG. 14, in specific embodiments, the center of the upper runner cover 2 has a hollow sleeve 25. The upper runner base 3 is fitted into or over the hollow sleeve 25 and the hollow sleeve 25 is set into the shaft 10, and the upper runner base 3 is held up against the said shaft 10.

In order to ensure that the connection between the upper hub 1 and shaft 10 is reliable, the bottom section of the hollow sleeve 25 is provided with positioning holes 26, the shaft 10 is provided with fastener holes 9 and the positioning holes 26 and the fastener holes 9 are connected with fasteners 91. With reference to FIG. 14, in specific embodiments, the positioning holes 26 are threaded holes, the fastener holes 9 are screw holes and the fasteners 91 are screws. The screws are screwed into the said threaded holes and screw holes to achieve the connection.

Any suitable structure can be employed to install the lower runner 4 on the shaft 10. With reference to FIG. 15, in specific embodiments, the lower runner cover 5 has a first center hole 55 and the third lower runner inverted fastening units 56 are located at the extension of the edge of the center hole. The lower runner base 6 should have a second center hole 65. The second center hole 65 has the third lower runner inverted grooves 66. The third lower runner inverted fastening units 56 are fastened to the third lower runner inverted grooves 66. The shaft 10 goes through the first center hole 55 and the second center hole 65 and is secured with the third lower runner inverted fastening unit 56. As no excess space between the third lower runner inverted fastening unit 56 and shaft 10, the lower runner will not fall off easily and thus achieve the effect of being immobilized.

Figure 4:
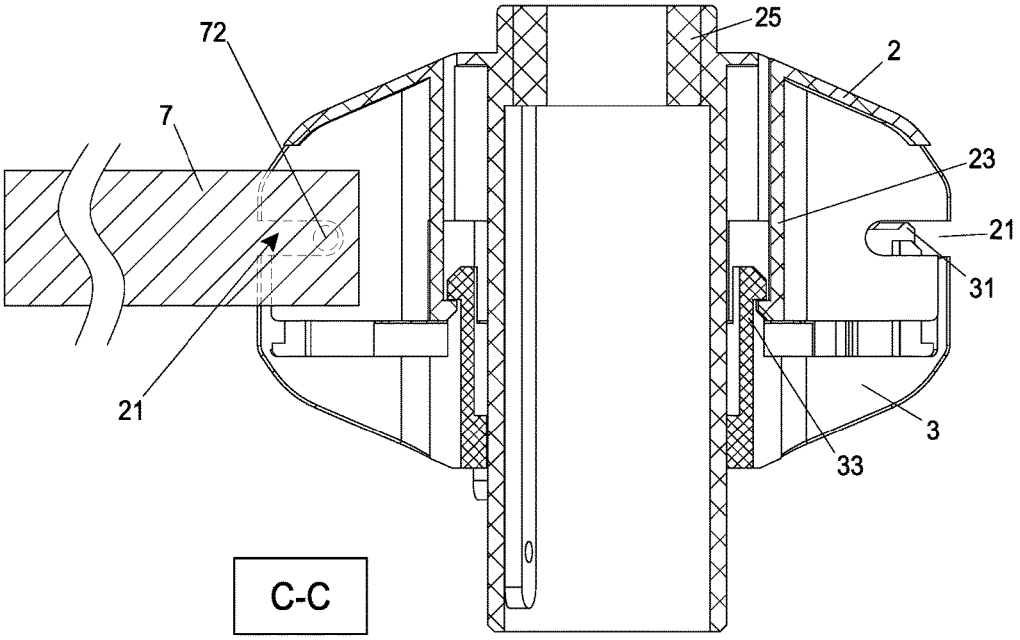
FIG. 4 is a schematic sectional view taken through section plane C-C in FIG. 1.
Figure 6:
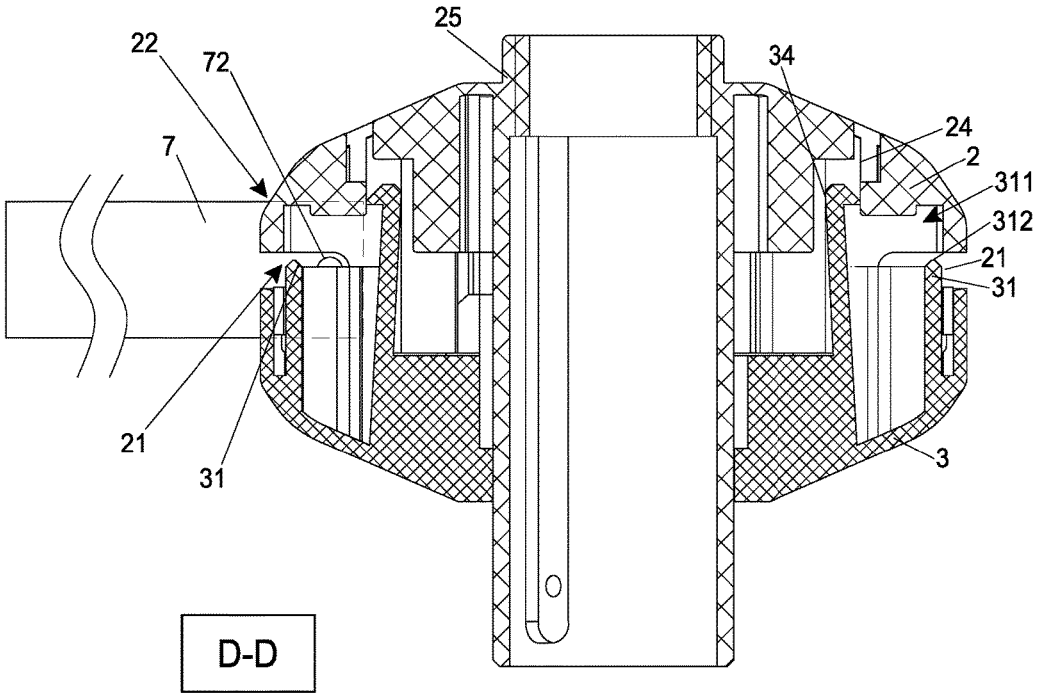
FIG. 6 is a schematic sectional view taken through section plane D-D in FIG. 5.
Figure 7:
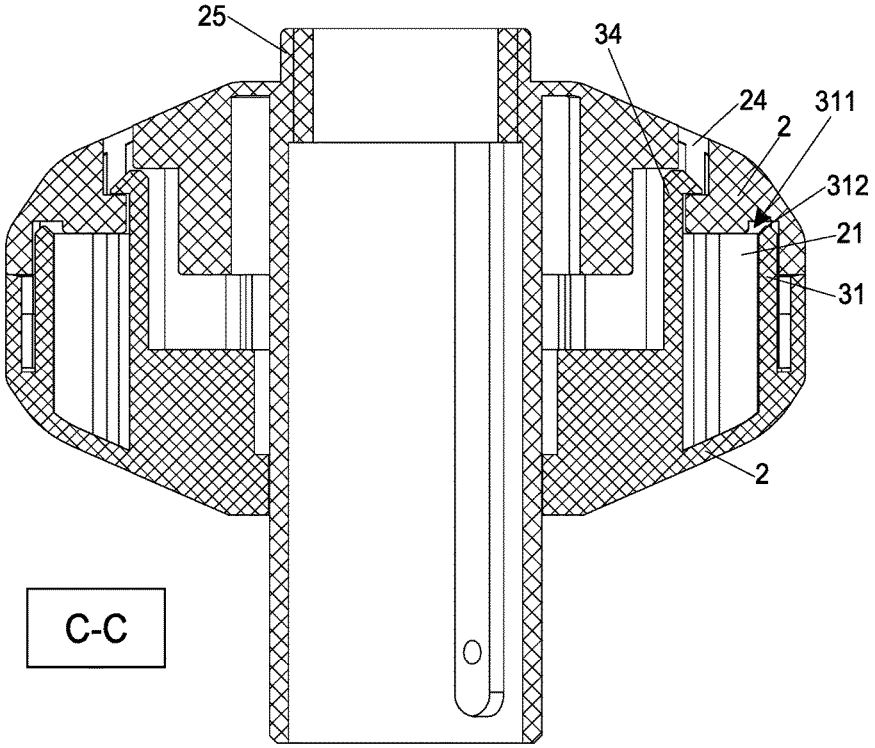
FIG. 7 is a schematic cross-sectional front view taken through section plane C-C of a specific embodiment shown in FIG. 1A in a second fastening position.

When the upper hub cover 2 and the upper hub base 3 are fitted together, it will cause the upper hub 1 to be fastened at position 1 as illustrated in FIGS. 1, 4 and 6. One end of the first ribs 7 is situated in the first upper runner vertical groove 22, and the two ends of the first shaft pins 71, 72 are situated in the two adjacent upper runner rib hitching grooves 21, which then pushes the first ribs 7, causing the first shaft pins 71, 72 to press against the upper runner stop blocks 31. At least a portion of the said upper runner stop blocks 31 will be displace, e.g., out of the upper runner rib hitching grooves 21 as a result of the elastic deformation of the upper runner stop blocks 31 or the elastic deformation arising from the fastening of the first upper runner inverted fastening unit 23 to the first upper runner inverted groove 33. Upon such displacement the shaft pins 71, 72 are able to enter the said upper runner rib hitching grooves 21. Thereafter, the upper runner stop blocks 31 return to their original position to immobilize or retain the shaft pins 71, 72. The upper hub cover 2 and the upper hub base 3 are moved closer to each other until they become mutually fastened at position 2 as illustrated in FIGS. 7 and 14. The upper hub stop blocks 31 will move further into the upper runner rib hitching grooves 21 and in turn completely seal up or block all the upper hub rib hitching grooves 21 to firmly immobilize or retain shaft pins 71, 72.

Figure 8:
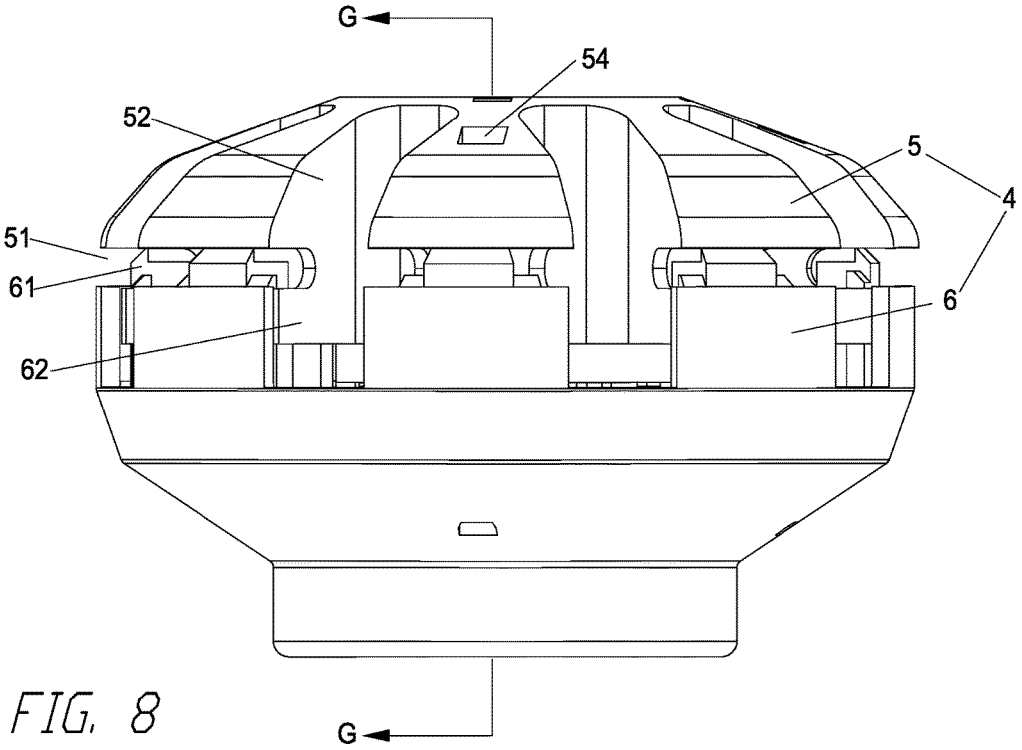
FIG. 8 is a schematic front view of a specific embodiment of the lower runner of this invention in a first fastening position.

Similarly, when the lower runner cover 5 and the said lower runner base 6 are fitted together, it will cause the lower runner 4 to fasten at position 1 as illustrated in FIGS. 8 and 11. One end of the second ribs 8 is situated in the first lower runner vertical groove 52, and the two ends of the shaft pins 81, 82 are situated in the two adjacent lower runner rib hitching grooves 51, which then pushes the second ribs 8, causing the second shaft pins 81, 82 to press against the lower runner stop blocks 61. At least a portion of the said lower runner stop blocks 61 will be displaced, e.g., out of the lower runner rib hitching grooves 51 as a result of the elastic deformation of the lower runner stop blocks 61 or the elastic deformation arising from the fastening of the first lower runner inverted fastening unit53 to the first lower runner inverted groove 63, and thus the shaft pins 81, 82 are able to enter the said lower runner rib hitching grooves 51. Thereafter, the lower runner stop blocks 61 return to their original position to immobilize or retain the second shaft pins 81, 82. The lower runner cover 5 and the lower runner base 6 move closer to each other until they become mutually fastened at position 2 as illustrated in FIGS. 12 and 15. The lower runner stop blocks 61 will move further into the lower runner rib hitching grooves 51 and in turn completely seal up or block all the lower runner rib hitching grooves 51 to firmly immobilize or retain shaft pins 81, 82.

Therefore, no fixtures, tools or screws are required, only the runner covers and runner bases need to be securely fastened. The fastening units will be firmly fastened and the umbrella ribs can be assembled upside down (horizontal assembly).

In summary, the upper and lower hubs of these embodiments are cleverly designed and structurally simple. In another embodiment, a quick frame assembly method is provided. FIGS. 6 and 7 illustrate parts of a method related to an upper hub for an umbrella. A base 3 or lower portion is coupled with a cover 2 or upper portion of the hub. The hub has a groove 22 for ribs to move in during umbrella operation. The hub has transverse grooves 51 for receiving and retaining shaft pins 71, 72 or other transverse members of an umbrella rib. Projections that may be flat members, referred to herein as stop blocks 31, are retention structures that are disposed on the base 3 but can also or alternatively be disposed on the cover 2. The retention structures extend into the transverse grooves 51 in a first assembly position (as in FIG. 6). One end of each rib of a plurality of ribs is inserted into the grooves 22 and ends of transverse members of the ribs into the transverse grooves 51. In one embodiment, the retention structures 31 are flexible so that when the shaft pins 81, 82 are pressed against them, the retention structures 31 are deflected. The deflection of the retention structures 31 permits the transverse members to be disposed in the transverse grooves. The position can be between the retention structures 31 and a central axis of the hub, e.g., passing through the center of the sleeve 25. Relative movement is provided between the cover 2 and the base 3 to move the cover and base in to engagement (as in FIG. 7). The cover 2 and base 3 of the hub in this position prevent deflection of the retention structures 31. Deflection is prevented in the FIG. 7 position because the retention structures 31 are received in a recess 311 that provides a rigid wall on both sides of the free end 312 of the retention structures 31. These rigid walls hold the free end 312 of the retention structures 31 so that the retention structures 31 will not deflect when the umbrella rib is loaded in normal use in a manner that permits the rib to be dislodged from the hub. There may be some deflection of course, but not sufficient to permit the free end 312 of the retention structures 31 to come free of the rigid structures into which it is received.

Various figures show hook-like projections, which may be referred to as "fastening units" and corresponding grooves or inverted grooves, which have surfaces for engaging the hook-like members. These structures define first and second positions in a discrete and very secure way. These structures are discussed above in great detail.

No fixtures, tools or screws are required for the rib assembly. The assembly is quick, easy and flexible, and the ribs can either be assembled vertically or horizontally. It is also suitable for large-scale application.

In this specification, embodiments have been described with reference to specific implementations. However, many modifications and variations can clearly still be made without departing from the essence and scope of the inventions. Therefore, the Specifications and drawings should be considered as illustrative rather than restrictive.

What is claimed is:

1. An assembly method, comprising:

actuating a first inverted fastening unit to couple a lower portion of a hub with an upper portion of the hub, the lower and/or upper portions defining a first groove for enabling movement of a rib or strut, the upper and/or lower portions defining a plurality of second grooves disposed transversely to the first groove, retention structures disposed on at least one of the upper and lower portions;

inserting one end of a first rib into the first groove and ends of shaft pins of the first rib into the second grooves;

causing the shaft pins to move from an outer periphery of the hub toward the retention structures within the second grooves;

disposing the shaft pins in the second grooves between the retention structures and a central axis of the hub;

after actuating the first inverted fastening unit, providing relative movement between the upper portion and the lower portion in a direction aligned with the central axis of the hub to actuate a second inverted fastening unit and coupling the lower portion of the hub with the upper portion of the hub;

blocking movement of the shaft pins towards the outer periphery of the hub with the retention structures and thereby retaining the shaft pins in the second groove.

2. The assembly method of claim 1, wherein the upper portion comprises the first inverted fastening unit and the lower portion comprises a first inverted groove and actuating the first inverted fastening unit engages the first inverted fastening unit with the first inverted groove.

3. The assembly method of claim 2, wherein the lower portion of the hub and the upper portion of the hub are coupled together by the second inverted fastening unit engaged with a second inverted groove.

4. The assembly method of claim 2, wherein the first inverted fastening unit comprises a deflectable cantilevered hook.

5. An assembly method, comprising:

coupling in a first position a lower portion of a hub with an upper portion thereof, the hub having a cavity therein;

inserting one end a rib into the hub such that an end of a transverse member of the rib is in the cavity;

providing relative movement between the upper portion and the lower portion of the hub to block the transverse member from being dislodged from the cavity with a retention member extending from one of the upper portion and the lower portion of the hub to a free end;

inserting the free end of the retention member into a recess in the other one of the upper portion and the lower portion of the hub that is opposite the retention member;

blocking the cavity with the retention member after inserting the one end of the rib into the cavity; and coupling the lower portion and the upper portion in a second position.

6. The assembly method of claim 5, wherein the relative movement between the upper portion and the lower portion of the hub is linear and closes a distance between the upper portion and the lower portion of the hub without required complete rotations of the hub portions relative to each other.

7. The assembly method of claim 5 further comprising securing the upper and lower portions of the hub together after inserting the free end of the retention member within the recess.

8. An assembly method, comprising:

coupling a lower portion of a hub with an upper portion of the hub, the lower and/or upper portions defining a first groove for enabling movement of a rib or strut, the upper and/or lower portions defining a plurality of second grooves disposed transversely to the first groove, retention structures disposed on at least one of the upper and lower portions;

inserting one end of each of a first plurality of ribs into the first groove and ends of shaft pins of the ribs into the second grooves;

causing the shaft pins to move from an outer periphery of the hub toward the retention structures;

disposing the shaft pins in the second grooves between the retention structures and a central axis of the hub;

pressing the shaft pins against the retention structures and deflecting the retention structures;

providing relative movement between the upper portion and the lower portion to move the upper and lower portions of the hub to a position in which movement of the shaft pins from the retention structures toward the outer periphery of the hub is prevented;

providing relative movement between the upper portion and the lower portion to move the upper and lower portions of the hub to a position in which deflection of the retention members is prevented;

wherein after providing relative movement, the retention members are substantially prevented from deflecting in the second grooves to prevent inadvertent withdrawal of the shaft pins from the second grooves.

9. An assembly method, comprising:

providing a shade structure rib-receiving component having an upper portion and a lower portion, the lower portion comprising a transverse rib-receiving groove having a first and a second rib-hitching slot;

engaging the upper portion with the lower portion wherein the first rib-hitching slot is in an open position and the second rib-hitching slot is in the open position engaging inserting a rib end into the transverse rib-receiving groove;

inserting a first transverse side of the rib end into the first rib-hitching slot and a second transverse side of the rib end into the second rib-hitching slot;

actuating an inverted coupling unit to couple the upper portion with the lower portion;

blocking the first and second rib-receiving slots to retain the first and second transverse sides of the rib end within the first and second rib-receiving slots, respectively;

wherein the inverted coupling unit comprises a first deflectable cantilevered hook extending a first distance from one of the upper portion and the lower portion of the shade structure rib-receiving component and a second deflectable cantilevered hook extending a second distance from one of the upper portion and the lower portion of the shade structure rib-receiving component, the second distance being greater than the first distance.

10. The assembly method of claim 9 further comprising, inserting a retention member attached to the upper portion into a cavity within the lower hub portion.

11. The assembly method of claim 10 wherein the retention member blocks the first rib-receiving slot.

12. The assembly method of claim 9, wherein the transverse rib-receiving groove is located across an interface of the upper and lower hub portions.

13. The assembly method of claim 9, wherein the first deflectable cantilevered hook is attached to the upper portion of the hub and the second deflectable cantilevered hook is attached to the lower portion of the hub.

* * * * *